United States Patent [19]

Zarchy

[11] Patent Number: 4,831,206

[45] Date of Patent: May 16, 1989

[54] CHEMICAL PROCESSING WITH AN OPERATIONAL STEP SENSITIVE TO A FEEDSTREAM COMPONENT

[75] Inventor: Andrew S. Zarchy, Amawalk, N.Y.

[73] Assignee: UOP, Des Plains, Ill.

[21] Appl. No.: 174,440

[22] Filed: Mar. 28, 1988

Related U.S. Application Data

[63] Continuation-in-part of Ser. No. 22,136, Mar. 5, 1987, abandoned.

[51] Int. Cl.[4] ..... C07C 5/13

[52] U.S. Cl. ..... 585/737; 208/91; 208/133; 208/208 R; 208/245; 208/299; 208/307; 208/302; 208/305; 208/213; 208/303; 502/517; 502/34; 585/822

[58] Field of Search ..... 55/74, 75; 208/91, 208 R, 208/245, 299, 307, 301, 310 R, 302, 305, 213, 303; 502/517, 34; 585/737, 822; 423/230, 573 R, 575, 244, 239

[56] References Cited

U.S. PATENT DOCUMENTS

| | | | |
|---|---|---|---|
| 2,937,215 | 5/1960 | Bleich et al. | 208/91 |
| 2,951,888 | 9/1960 | Carr | 585/737 |
| 2,951,993 | 2/1961 | Kimberlin, Jr. et al. | 585/737 |
| 3,063,933 | 11/1962 | Meiners | 208/91 |
| 3,063,934 | 11/1962 | Epperly et al. | 208/91 |
| 3,069,349 | 12/1962 | Meiners | 585/737 |
| 3,506,733 | 4/1970 | Mayhue | 585/737 |
| 3,540,998 | 11/1970 | Bercik et al. | 585/737 |

*Primary Examiner*—H. M. S. Sneed
*Assistant Examiner*—Helane Myers
*Attorney, Agent, or Firm*—Morris N. Reinisch

[57] ABSTRACT

The present invention relates to a chemical process involving a processing step which is sensitive to the presence of at least one component contained within the stream to be processed. In particular, the present invention relates to an economical and efficient method of integrating the means for removing the deleterious component with the sensitive processing step by the use of a sorbent which is capable of removing the at least one deleterious component at sorption conditions which enables the stream to be in the vapor phase for subsequent introduction to the sensitive processing step which is also carried out in the vapor phase. Most preferably, the sorption conditions are substantially the same as the conditions within the sensitive processing step.

21 Claims, 5 Drawing Sheets

CHEMICAL PROCESSING WITH AN OPERATIONAL STEP SENSITIVE TO A FEEDSTREAM COMPONENT

CROSS-REFERENCE TO RELATED APPLICATIONS

This application is a continuation-in-part of application Ser. No. 022,136, filed Mar. 5, 1987 now abandoned, the contents of which are incorporated herein by reference.

BACKGROUND OF THE INVENTION

1. Field of the Invention

This invention pertains to the field of chemical processing involving at least one processing step which is sensitive to the presence of at least one component contained within the stream to be processed. More particularly, the present invention relates to a process which economically and advantageously integrates the means for removing the deleterious component with the sensitive processing step by the use of a sorbent which is capable of selectively removing the at least one deleterious component at sorption conditions which enable the stream to be in the vapor phase for subsequent introduction to the sensitive processing step which is also carried out in the vapor phase.

2. Discussion of Related Art

There are many chemical processes in which there is at least one processing step which is sensitive to at least one component contained within the feedstream to the process or to a component which is generated within the process upstream of the at least one sensitive step. Generally, the presence of the sensitive step necessitates the removal of all or most of the at least one deleterious component prior to its being introduced into the sensitive processing step.

These sensitive processing steps may include essentially all aspects of unit operations involved in chemical engineering practice. Thus, there are many chemical processes which cannot tolerate the presence of particular constituents which may be contained within the feedstream. For example, one such process involves the use of membranes for separating methane from natural gas where the presence of condensibles, such as, pentane, hexane, or the like, would be detrimental to the membrane. So too, in those chemical reactions where a catalyst is employed, such catalyst is typically sensitive to various chemical constituents as well. Such sensitive catalysts include, for example, an iron oxide catalyst which is used for the formation of ammonia and which is particularly sensitive to carbon oxides. Without the removal of these deleterious components from the reaction zone, the catalyst will be poisoned, the reaction will not proceed, or proceed very poorly, or totally undesirable side reactions will take place.

Chemical reactions are not the only place in which the presence of certain components causes detrimental results. Thus, when using ion exchange resins, for example, it is frequently necessary to remove certain components from the stream to be processed prior to its being introduced into the ion exchanger. The presence of certain components within the feedstream could very well interfere with the ion exchange process or even destroy its utility completely. More specifically, when ion exchanging water to replace calcium ions with potassium ions, for example, the presence of sodium ions within the fluid stream would be detrimental to the ion exchange process requiring that the sodium ion be removed upstream of the process.

Even in certain distillation steps, particularly during azeotropic distillation, the presence of certain components within the fluid stream to be processed may be deleterious to the successful separation of the azeotropic solution. Again, this necessitates the removal of these constituents prior to the distillation step. The same holds true for still other unit operations, such as, irreversible absorbtion when using zinc oxide, for example, and the like.

No matter which sensitive processing step is involved, it is readily apparent that steps must be and are taken to remove the deleterious components from the stream prior to such stream entering the sensitive step.

There are many chemical operations in which the sensitive processing step is carried out while the stream that is being processed is in the vapor phase. Yet, even though the deleterious component removal steps may immediately precede the at least one such sensitive processing step, and although such removal steps frequently include a step in which the stream to be processed is in the vapor phase, the remaining deleterious component removal steps, however, may be such that they typically require that the stream be condensed to the liquid phase in order to carry out these additional steps. This is true despite the fact that it would clearly be most advantageous and desirable to retain the stream in the vapor phase while being subjected to the deleterious component removal steps in view of the subsequent sensitive processing step which, in this instance, is also carried out while the stream in the vapor phase.

Hence, after having its at least one deleterious component removed, the stream that is being processed, now in the liquid phase, must again be brought to the vapor phase in order to carry out the sensitive processing step. Manifestly, the necessity of having to undergo such repeated phase changes disadvantageously results in the additional expenditure of both capital and operating costs that are associated with carrying out such phase changes.

One particular chemical processing area in which such repeated phase changes are required can be found in the petroleum refining industry, particularly in the hydrotreating processes in which deleterious components are removed from hydrocarbon feedstocks prior to entering such downstream processing operations, as isomerization, catalytic reforming, and the like.

Hydrotreating is a process for catalytically reacting the objectionable elements contained within the feedstock with hydrogen and then removing the hydrogenated form of the deleterious components. Typical objectionable elements removed by hydrotreating include sulfur, nitrogen, oxygen, halides and trace metals, with sulfur and its compounds generally being the most prevalent. Removal of at least the sulfur and nitrogen is required so as to prevent poisoning of the catalysts that are used in isomerization, catalytic reforming, and the like, which are generally both sulfur and nitrogen sensitive. When the hydrotreating process is specifically utilized for the removal of sulfur and nitrogen bearing components, it is usually referred to in the art as hydrodesulfurization.

Such a hydrodesulfurization process is typically conducted on a hydrocarbon feedstream intended for subsequent isomerization containing at least four carbon atoms, particularly light straight run gasoline or light naphthas. Such a feed typically contains sulfur bearing compounds on the order of about 200 ppm of sulfur and nitrogen bearing compounds on the order of about 0 to 10 ppm. As used herein, the term "sulfur" is meant to include sulfur and sulfur bearing compounds and the term "nitrogen" is meant to similarly include nitrogen as well as nitrogen bearing compounds. Such levels of sulfur and/or nitrogen generally adversely affect the performance and life of the isomerization catalyst. Consequently, such a feed is conventionally treated by a hydrodesulfurization step to remove the sulfur and any nitrogen contained therein upstream of the isomerization reactor.

The hydrodesulfurization process, as discussed in, for example, U.S. Pat. No. 3,461,062, the contents of which are incorporated herein by reference, generally involves a pump to transfer the hydrocarbon feedstock to a furnace heater in which the typically liquid feedstream is first vaporized. The now vaporous hydrocarbon stream is then passed into a hydrotreating reactor which catalytically converts, in the presence of hydrogen, the sulfur and any nitrogen present in the feedstream to hydrogen sulfide and ammonia, respectively. A vaporous hydrogen sulfide and ammonia containing feedstream is then withdrawn which must be condensed in order to proceed with the next hydrogen sulfide and/or ammonia removal steps.

In the condenser, generally about about 40% of the gaseous hydrogen sulfide and ammonia is condensed along with the feedstream while the remaining hydrogen sulfide and ammonia leave the condenser as overhead. The now liquid hydrocarbon stream, still containing about 60% to 70% hydrogen sulfide and ammonia, is then passed through a hydrogen separator to remove excess hydrogen and any $C_3$ and lighter components.

The liquid hydrocarbon stream is then passed through a step which substantially removes the hydrogen sulfide and ammonia components from the stream. Such a hydrogen sulfide and ammonia removal step is typically carried out in a steam stripper column in which the condensed hydrogen sulfide and ammonia contained within the feedstream are removed. In lieu of such a steam stripper column, a hydrogen sulfide and ammonia adsorption bed, or an amine scrubber solution, may also be used provided that the feedstream is cooled further to the proper temperature prior to being introduced to these alternative removal means.

The hydrocarbon feedstream is now ready to be isomerized. However, regardless of whether a steam stripper, an adsorber, or an amine solution was utilized to remove the hydrogen sulfide and/or ammonia, the hydrocarbon stream, now having essentially all of its sulfur and nitrogen content removed, must now be reheated in order to convert it to a vapor once again so that it is in the proper phase necessary for being introduced into the isomerization reactor.

While such a hydrodesulfurization technique for sulfur and nitrogen removal is an effective means for dealing with the presence of sulfur and nitrogen, it is extremely costly. In fact, the conventional practice is to run the hydrodesulfurization unit separately and independently from the isomerization unit which clearly adds to the complexity of the process and to its overall costs. So too, the necessity of repeatedly having to heat and cool the feedstream so as to effect a phase change to accommodate different process steps also adversely affects the economics and efficiency of the overall process.

This is but one example in which a need clearly exists to be able to effectively remove at least one deleterious component from a feedstream in an industrial process which contains a step which is sensitive to this at least one component in an economical and efficient manner.

SUMMARY OF THE INVENTION

Applicant has discovered a process for removing deleterious component from a fluid stream which fluid stream, having a reduced content of deleterious component, is then able to proceed to a sensitive step of the processing operation without the need to undergo a series of phase changes thereby avoiding substantially all of the disadvantages noted above.

More particularly, Applicant's process involves a totally new approach to the use of sorbents, especially adsorbents, wherein the feedstream containing at least one deleterious component is contacted with a sorbent while in the vapor phase which is capable of selectively removing the at least one deleterious component as compared to the remaining components contained within the feedstream and then, while still maintaining the feedstream in the vapor phase, subjecting the feedstream effluent, now having a reduced concentration of deleterious component, to the step of the processing operation which is sensitive to the at least one deleterious component, which sensitive step is carried out in the vapor phase at conditions suitable for such sensitive step. Most preferably, the sorption conditions are essentially the same as the processing conditions of the sensitive step.

Accordingly, by virtue of the present invention, it is now possible to carry out a chemical process containing a step sensitive to a deleterious component present in the feedstream, which sensitive process is carried out essentially in the vapor phase, in an integrated manner such that the deleterious component removal step is advantageously also carried out entirely in the vapor phase, preferably under conditions which are essentially the same as the conditions utilized in the sensitive processing step.

In this manner, the present invention provides for the overall operation to be significantly enhanced enabling desirable processing and corresponding equipment simplification to be achieved as compared to conventional practice. This not only reduces operating costs, but quite significantly, reduces initial capital cost investment, as well.

One of the features of the present invention which facilitates the removal of deleterious component from the feedstream while the stream is in the vapor phase, preferably at sorption conditions which are essentially the same as the conditions within the downstream sensitive processing step, is Applicant's discovery that it is possible to utilize adsorbents at adsorption conditions which heretofore were thought totally impracticable due to their having a very low capacity at such conditions.

More specifically, most adsorbents are utilized at low temperatures during adsorption and at high temperatures for regeneration. In the present invention, Applicant has discovered that it is indeed possible to operate the adsorption bed even at high temperatures, temperatures which are conventionally used for regeneration, by frequently cycling the adsorption/desorption phases of the adsorption cycle, generally frequently enough to prevent breakthrough of the adsorbed deleterious components. As a result of this ability to utilize the absorbent at both high or low temperatures, Applicant has made it possible to no longer make it necessary to provide additional means and to expend the concomitant costs for lowering the temperature of a feedstream, specifically to the liquid phase, just to accommodate the requirements of the conventional deleterious component removal means. Instead, by means of the present invention, it is now possible to provide a deleterious component removal means at conditions which are essentially similar to the downstream sensitive processing step such that the stream can advantageously and desirably be maintained in the vapor phase thereby facilitating the integration of these two operations into one process wherein, if desired, the stream leaving the deleterious component removal means, while still in the vapor phase, may immediately be introduced into the sensitive processing step.

The present invention is not limited, however, to the use of only adsorbents, albeit that such adsorbents are being used in a novel manner in the present invention. Applicable chemisorbents may also be utilized as a sorbent material, preferably when the amount of deleterious component to be removed by such chemisorbent is relatively low, for example, generally about 1 to 25 ppm of hydrogen sulfide. Typically, chemisorbents such as zinc oxide generally have better loading characteristics at elevated temperatures thereby making them quite suitable for use in the present invention in which the temperature conditions will be elevated so as to maintain the stream in the vapor phase.

As long as there is a sorbent, whether an adsorbent or a chemisorbent, which is capable of selectively removing one or more components from a fluid stream, such a sorbent can now be utilized in the process of the present invention for effectively facilitating the integration of the deleterious component removal means with the sensitive processing step thereby enabling the stream to be maintained in the vapor phase and avoiding unnecessary phase changes and the corresponding costs associated therewith.

Accordingly, in its most broadest embodiment, the present invention, as it pertains to the use of adsorbents at elevated temperatures, may be characterized as follows:

In a method for the removal of at least one component from a vaporous stream containing at least one other component in which the vaporous stream is contacted with an adsorbent selective for the at least one component as compared to the at least one other component while the adsorbent is in an adsorption mode under adsorption conditions and at a first adsorption temperature to provide an adsorption effluent containing a reduced concentration of the at least one component and in which the adsorbent, now laden with the at least one component, is regenerated by passing a purge medium through the adsorbent to desorb at least a portion of the at least one component under desorption conditions and at a first desorption temperature which is greater than the first adsorption temperature, the improvement which comprises contacting the vaporous stream with the adsorbent under adsorption conditions at a second adsorption temperature which is at least equal to the first desorption temperature and regenerating the adsorbent at a second desorption temperature which is greater than or equal to the second adsorption temperature. Preferably, the adsorbent is regenerated before there is any breakthrough of the at least one component from the adsorbent.

One particularly preferred embodiment of the present invention is the means by which the adsorbent is regenerated. Generally, in order to desorb a deleterious component from an adsorbent, there must be a readily available supply of purge gas which must also be at the proper regenerating temperature. This is not always feasible at a particular plant site. Correspondingly, once the adsorbent has been regenerated with the purge gas, the purge gas, now laden with the deleterious component, must still be dealt with. Flaring of such a purge gas is not always feasible or desirable.

In this especially preferred embodiment, the stream being processed and containing a deleterious component is first passed through an adsorption zone containing a solid adsorbent capable of selectively absorbing deleterious component as compared to the remaining components contained within the stream under adsorption conditions. The stream, now containing a reduced concentration of deleterious component, then proceeds to the remaining process steps ultimately passing through the step which is sensitive to the deleterious component producing a product effluent. In this preferred embodiment, at least a portion of this product effluent (as opposed to any waste stream leaving the sensitive processing step) is then ultimately utilized as purge gas for the regeneration of the adsorbent bed, now laden with deleterious component, under desorption conditions to provide a product effluent having an increased concentration of deleterious component.

Thus, instead of using an externally provided purge stream or being limited to using waste streams produced in the process for the regeneration of an adsorbent and being correspondently faced with the problems of adequate supply and disposable of this regenerating stream once it has been used for regeneration purposes, the preferred embodiment of the present invention provides for the elegant solution of actually utilizing the product stream itself as a purge medium once the sensitive step of the process has been carried out absent the presence of the detrimental component. This is particularly advantageous where it is desired to have the deleterious component present in the product stream.

One specific example in which it is particularly advantageous to have the deleterious component present in the product effluent is in the process for preparing acrylic acid. Such a process generally involves the reaction of propylene with oxygen in the presence of a sulfur-sensitive catalyst. Due to the substantially similar boiling points of the propylene and the sulfur bearing compounds, such as, hydrogen sulfide, carbonyl sulfide, and the like, it has generally been quite difficult and expensive to remove the deleterious sulfur compounds. By virtue of the present invention, however, the feedstream containing the propylene and sulfur compounds can now be passed into an adsorbent which is selective for the sulfur compounds as compared to the propylene. The propylene, now essentially free of the sulfur compounds, is then reacted with oxygen to form the acrylic acid product effluent. This product effluent is then used to regenerate the adsorbent and desorb the sulfur bearing compounds from the adsorbent. Now, however, instead of having the combination of propylene and sulfur compounds, a combination of acrylic acid and sulfur compounds exists. Because there is a difference of about 200° F. between the boiling points of the acrylic acid and the sulfur bearing compounds, respectively, it is now quite a simple matter to separate one constituent from the other, all made possible by the preferred embodiment of this invention.

Furthermore, as a still further advantage of this preferred embodiment of the present invention, inasmuch as the sensitive step of the process will generally involve the use of relatively high temperatures, once the vaporous stream passes through this step absent the deleterious component, the effluent from this step will typically be at a temperature which is generally desirable for the desorption of the adsorbent. Consequently, when the effluent is returned to the adsorption bed to be used as a purge stream for regeneration, it will usually not be necessary to expend the costs of heating this effluent stream, resulting in yet an additional economical savings.

As a practical matter, in order to provide for continuity of this preferred embodiment, the adsorption step is generally carried out with at least two adsorption zones such that at least one such zone is in the adsorption mode and at least one other of such zones is in the desorption mode. These zones are switched or cycled in service at intervals that generally would preclude breakthrough of the adsorbed deleterious component. In this manner, a vaporous feedstream containing one or more deleterious components can continuously flow to an adsorption zone, the effluent from which can flow continuously to at least the sensitive step of the process, and at least a portion thereof be passed continuously to a desorption zone. At the proper point in time, that is, when the adsorption zone is substantially laden with deleterious component and usually before there is any breakthrough, the adsorption zone is switched to become a desorption zone and the desorption zone is switched to become an adsorption zone in conjunction with the proper switching of the vaporous feedstream flow path.

It is to be understood that in the present invention, it is not necessary to have the effluent leaving the sorption step immediately be subjected to the sensitive process step although that may indeed be most desirable. So too, it is also not necessary that immediately after being subjected to the sensitive processing step, the thusly treated stream immediately be utilized as a desorption or purge medium, in whole or in part, in accordance with the preferred embodiment of the present invention, in which a regenerable adsorbent is utilized to remove the deleterious component from the feedstream.

Thus, there may be one or more process steps that are carried out on the sorption effluent prior to its being introduced into the sensitive step of the process in which the stream remains in the vapor state so that it still advantageously remains in that phase so as to economically then be utilized in the sensitive processing step.

So too, in the embodiment in which a regenerable adsorbent is utilized and still further, in the preferred embodiment of utilizing the product effluent as the purge medium for such adsorbent, there may also be one or more processing steps carried out on the material discharged from the sensitive processing step prior to its being used, in whole or in part, as the desorption or purge medium. After such desorption, if desired, the product effluent, now once again containing deleterious component, may be treated by any conventional means for its removal.

Accordingly, by the use of sorbents in this manner, Applicant has been able to avoid the necessity of having numerous phase changes typically required for the removal of deleterious component from a feedstream, which stream is then passed to a sensitive processing step which is carried out in the vapor phase. In its more broader embodiment, this new process may be characterized as follows:

In a process for performing an operation involving at least one component of a fluid stream to provide product containing said at least one component or a chemical derivative thereof, said fluid stream containing at least one other component which is deleterious in at least one step of the operation which is sensitive to said at least one deleterious component, involving the steps of:

(i) subjecting the fluid stream to a deleterious component removal step in which the fluid stream undergoes at least one phase change including a phase change from the vapor phase to the liquid phase so as to produce an effluent which is substantially in the liquid phase having a reduced concentration of the at least one other component;

(ii) subjecting the liquid effluent to at least one phase change step in which the liquid effluent is converted to essentially the vapor phase; and while essentially still in the vapor phase, (iii) subjecting the vaporous effluent to the at least one step of the operation which is sensitive to the at least one other component under pressure and temperature conditions which are sufficient to carry out the at least one step of the operation, so as to provide the product, the improvement which comprises:

(a) reducing the concentration of the at least one other component in the fluid stream by contact with a sorbent selective for the sorption of the at least one other component as compared to the at least one component while the fluid stream is in the vapor phase and under sorption conditions sufficient to maintain the fluid stream essentially in the vapor phase and capable of achieving the reduction of the at least one other component from the fluid stream to produce a vaporous effluent having a reduced concentration of the at least one other component; and then, while still in the vapor phase and without any phase change;

(b) subjecting the vaporous effluent to the at least one step of the operation which is sensitive to the at least one other component under pressure and temperature conditions sufficient to carry out the at least one sensitive step of the operation and produce the product. In a preferred embodiment of the present invention, the sorption conditions of step (a) are essentially the same as the pressure and temperature conditions in the at least one sensitive step of the operation.

In a more specific embodiment of the present invention, Applicant's process is particularly applicable to hydrotreating and, more specifically, to hydrodesulfurization in which the use of sorbents capable of selectively removing deleterious component from the hydrocarbon stream enables the integration of such a hydrotreating process with the downstream processing step which is sensitive to the deleterious component being removed in the hydrotreating part of the operation. By means of the use of such sorbents, in lieu of conventional techniques which require a series of phase changes in order to carry out such deleterious component removal, the stream is now able to be maintained under temperature and pressure conditions in the sorption zone which are substantially similar to the conditions required for the downstream sensitive processing step. In other words, the deleterious component removal step is carried out entirely in the vapor phase such that the vaporous effluent can immediately be introduced into the sensitive processing step which is carried out in the vapor phase as well. In this manner, equipment which is conventionally necessary in order to provide the required phase changes needed to accommodate the particular deleterious component removal means is eliminated along with its corresponding operating costs and inefficiencies.

Further in connection with this embodiment, Applicant has discovered that it is possible to effectively utilize hydrogen sulfide/ammonia adsorbents to accomplish the objective of maintaining the feedstream in the vapor phase during the deleterious component removal step while at a high temperature despite the fact that it well known to those skilled in the art that such hydrogen sulfide adsorbents have low capacity for removing hydrogen sulfide/ammonia at such high temperatures.

Unlike the prior art hydrogen sulfide adsorption techniques where vaporous or liquid sulfide containing hydrocarbon feeds are passed through the adsorption zone at relatively low temperatures, generally in the range of from about 60° to 200° F., in the present invention, vaporous sulfide containing and/or ammonia containing hydrocarbon feed is passed through the adsorption zone at high temperatures which are well above the dew point of the feedstream, generally in the range of from about 250° to 600° F., temperatures which ordinarily are used in the prior art only for desorption of the hydrogen sulfide/ammonia from the adsorbent with a purge gas.

Thus, Applicant has found that by frequently cycling the adsorbents from the adsorbtion mode to the desorption mode and back again, particularly where the feedstream is utilized as the purge medium, it is indeed possible to utilize these adsorbents at high temperatures. Thus, in a conventional hydrogen sulfide/ammonia adsorption step, an adsorption bed may be on the adsorption mode in the range of from about 8 to 24 hours. In the present invention, however, the hydrogen sulfide/ammonia adsorption lasts for only about 0.5 to 6.0 hours before the bed is switched to the desorption mode.

Specifically, this preferred embodiment of the present invention involves first catalytically converting the hydrocarbon feedstream into hydrogen sulfide and ammonia by means of a hydrotreating step and then, while in the vapor state and at a high temperature, passing the hydrogen sulfide and/or ammonia containing hydrocarbon feedstream through an adsorption zone containing a solid adsorbent selective for the adsorption of hydrogen sulfide and ammonia as compared to the hydrocarbon feed thus providing a hydrocarbon feed having reduced hydrogen sulfide and ammonia content. This feed is then ultimately passed through the sulfur/ammonia sensitive step of the process, which is typically a catalytic reaction zone such as an isomerization step, a catalytic reforming step, and the like.

This embodiment of the present invention may be characterized as follows:

A process for the conversion of a hydrocarbon stream containing sulfur and/or nitrogen components in a reaction zone suitable for said conversion to produce a hydrocarbon product, said conversion being deleteriously affected by the presence of said sulfur and/or nitrogen components comprising:

(a) catalytically reacting said hydrocarbon stream at a temperature and with sufficient molecular hydrogen to catalytically convert substantially all of the contained sulfur components to hydrogen sulfide and substantially all of the nitrogen components to ammonia, said temperature being such that the hydrocarbon stream is essentially in the vapor phase;

(b) contacting the vaporous hydrogen sulfide and/or ammonia containing hydrocarbon stream with a sorbent selective for the sorption of hydrogen sulfide and ammonia as compared to the hydrocarbon at sorption conditions sufficient to maintain the hydrocarbon stream in the vapor phase and capable of achieving the reduction in hydrogen sulfide and/or ammonia content in the hydrocarbon stream to provide a hydrocarbon stream having reduced hydrogen sulfide and/or ammonia content; and then (c) passing the hydrocarbon stream having reduced hydrogen sulfide and/or ammonia content, while still in the vapor phase, to the reaction zone at conditions suitable for the conversion to produce the hydrocarbon product including temperature and pressure conditions sufficient to maintain the hydrocarbon and hydrocarbon product essentially in the vapor phase. In a preferred embodiment of the present invention, the sorption conditions are essentially the same as the temperature and pressure conditions in the reaction zone.

By virtue of the present invention, it has been realized that a sorbent, such as, an adsorbent or a chemisorbent, may be utilized to remove deleterious component from a feedstream at elevated temperature. Consequently, as a further extension of the present invention, it is now possible to integrate the deleterious component removal step with the sensitive processing step such that the stream is maintained in the vapor phase thereby eliminating the need for gas compressors, heaters and coolers, etc., and their corresponding costs which have been required in the prior art in order to accommodate the necessary phase changes for carrying out the deleterious component removal step followed by the sensitive processing step.

Indeed, in connection with the isomerization or catalytic reforming processes which have generally been run independently of the hydrodesulfurization technique, by means of the present invention, it is now possible to integrate the hydrodesulfurization section of the process with the isomerization process or catalytic reforming section so as to obtain a new, simplified, economical and efficient process which effectively eliminates much of the equipment previously needed when these two sections of the overall process were essentially run as independent processes.

More specifically, by providing such an integrated hydrodesulfurization/isomerization or, alternatively, a hydrodesulfurization/catalytic reforming process, the elimination of extensive equipment from the conventional process, such as, a furnace heater, a feed/product heat exchanger, a steam stripper column and its associated components, a recycle compressor, a hydrogen separator, a feed pump and a product cooler, and the costs associated with running such equipment, represents the kind of savings that can be realized by the present invention.

Furthermore, by using, in the preferred embodiment of the present invention, the hydrocarbon product effluent as a purge gas to desorb deleterious component from the deleterious component-laden adsorbent, which effluent will generally be at an elevated temperature required for such desorption inasmuch as it will be coming from the sensitive reaction step which is carried out in the vapor phase, it is generally not necessary to provide an external purge gas, which must not only be heated but must also be in sufficient supply. Here, there is always a sufficient supply of purge gas since it is the product itself which is being utilized and which is generally going to be at the proper desorption temperature.

So too, by not passing an externally provided purge gas through the system, there is less chance for any contamination of the hydrocarbon feedstream from foreign matter being introduced by such external purge gas.

Still further, by means of this embodiment of the present invention, whatever was removed in the adsorption zone is conveniently and sufficiently returned to the hydrocarbon stream. This is particularly advantageous in situations where the necessity for the deleterious component removal is brought about simply by the sensitivity of one or more processing steps, but not because the presence of this component is objectionable in the end product. Thus, where the presence of a deleterious component, such as sulfur, can be tolerated in the end product, this specific embodiment of the present invention, which involves a temporary removal of the deleterious component, would suffice to meet the needs of such a product and therefore the extra equipment and costs required for the permanent removal of the deleterious component are advantageously eliminated.

Moreover, in those situations where the deleterious component, such as sulfur, is objectionable in the end product, such sulfur, already in the form of hydrogen sulfide, can readily and inexpensively be removed from the cooled end product, such as by flashing or by conventional stabilization procedures.

DETAILED DESCRIPTION OF THE INVENTION

Figure 1:
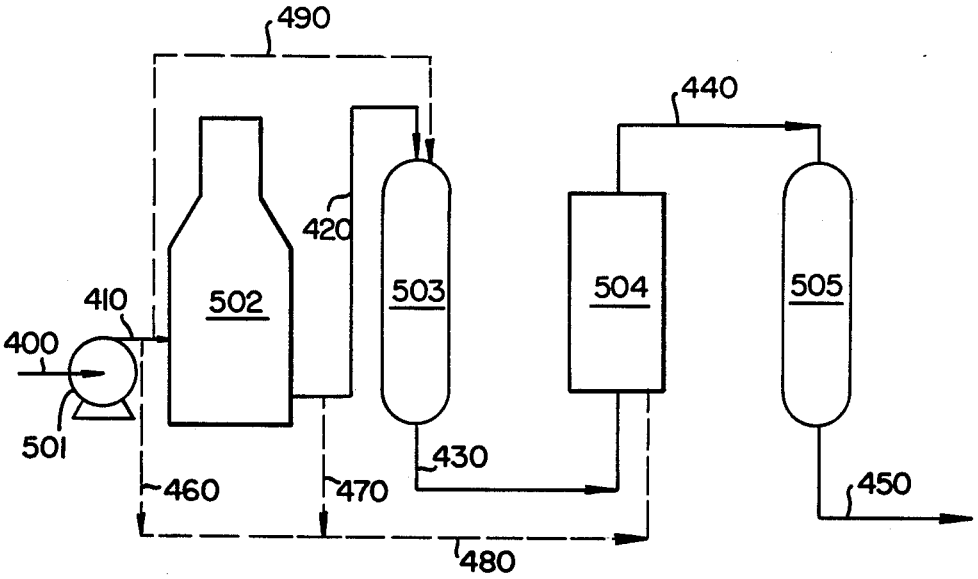
FIG. 1 is a schemtic flow sheet of the broader embodiment of the present invention showing the integration of the deleterious component removal step with the sensitive processing step.

Referring to FIG. 1, which depicts the present invention in its most simplified version and represents just one portion of an overall chemical process which contains a processing step which is sensitive to one or more components present in the stream to be processed, a fluid feedstream containing at least one component which is detrimental to at least one processing step within the process and at least one other component which is to have a processing operation performed on it in the sensitive processing step enters line 400 into pump 501. This fluid stream may be the feedstock to the overall chemical process which already contains the deleterious component, or alternatively, this fluid stream may be an intermediate stream in the overall process which has already been treated by one or more processing steps in which a deleterious component has been generated. In either case, this stream, prior to being introduced to the sensitive step, must be treated so as to remove the one or more deleterious components.

In the process of the present invention, the sensitive processing step is one which is generally carried out while the stream to be processed is in the vapor phase. Consequently, the deleterious component removal steps in the process of the present invention also require that the feedstream be in the vapor phase as well. Thus, the fluid feedstream is pumped from pump 501 to heater 502 in which the fluid stream is heated to the extent that there is a phase change and the feed is converted to a vapor, which is required for the subsequent processing steps. Such a heater or furnace is well known in the art and is conventionally utilized in chemical processing techniques.

The present invention is not limited to the particular fluid feedstream that is being processed provided that there is a sorbent which is capable of removing deleterious component that may be present therein prior to its introduction into a downstream sensitive processing step. Although hydrocarbon fluid streams are typical of the type of stream that is processed by the present invention, other types of streams are, of course, also applicable.

The fluid stream, now in the vapor phase, is then typically passed through line 420 to a converter 503. In converter 503, which is typically a catalytic converter, deleterious component contained within the vaporous feedstream is converted to a form which is more susceptible of being removed by a sorbent. Generally, for example, the selectivity of most sorbents are such that it is generally desirable to convert sulfur and sulfur bearing compounds contained within the fluid stream to hydrogen sulfide which is more readily and selectively sorbed by the sorbents. Similarly, nitrogen and nitrogen bearing compounds are also advantageously converted to ammonia for subsequent removal by the sorbent. Still other deleterious components which are desirably converted to another form in order to be more readily sorbed by a sorbent include carbon oxides and alcohols which are converted to water by means of such a converter.

Of course, if the fluid stream is already in the vapor phase when entering line 400, it need not be passed through heater 502 and can instead be passed through dotted line 490 directly into converter 503. Similarly, if the fluid stream contains deleterious component which is already in the proper form for subsequent sorption, the vaporous stream leaving heater 502 need not then be passed through converter 503, but rather, may be passed directly to the sorbent by means of dotted lines 470 and 480. Finally, if the fluid stream is in the vapor phase when entering line 400 and the deleterious component is already in the form required by the sorbent, then the stream may simply enter line 410, dotted lines 460 and 480, respectively, to immediately be introduced into sorbent bed 504.

Sorbent bed 504 contains sorbent which is selective for the one or more deleterious components contained within the stream as compared to the remaining stream constituents, at the temperature and pressure conditions existing in the sorbent bed.

The selection of a particular sorbent for a specific application is well known to those skilled in the sorption art. Generally, any sorbent which is capable of sorbing one or more deleterious components from the remaining constituents of the vaporous stream at the temperature and pressure conditions maintained therein may be used as a sorbent in the present invention.

As briefly discussed earlier, one of the preferred objectives of the present invention is to provide sorption conditions which most nearly duplicate the conditions existing in the downstream sensitive processing step. In this manner, the stream, while still in the vaporous phase and without the necessity of carrying out any additional phase changes, can immediately, if desired, be introduced to the sensitive processing step which is carried out under temperature and pressure conditions which are essentially the same as those existing in the sorption bed.

Typical sorption conditions which, of course, in the preferred embodiment of the present invention are dependent upon the conditions required for the sensitive processing step, include temperatures of from 150° to 750° F., preferably from 300° to 550° F. and pressures of 1 atmosphere to 50 atmospheres, preferably from 10 to 40 atmospheres.

It is to be noted that at the very least, the processing conditions within the sorption bed are such that the feedstream is maintained in the vapor phase. Thus, although one of the objectives of the present invention is to ideally provide sorption conditions which are essentially the same as the conditions required for the sensitive processing step, it is possible that the sensitive processing step may require conditions that are too severe for the sorbent, particularly an adsorbent, such as a very high temperature requirement. In such a situation, the sorbent bed would be operated at a temperature as high as possible and then the sorption effluent would be heated to obtain the higher required temperature. Nevertheless, however, the primary objective of the present invention is satisfied in such an embodiment inasmuch as the stream is still maintained in the vapor phase throughout the deleterious component removal step and is provided to the sensitive processing step while still in such vapor phase.

Typical adsorbents which may be used in the present invention include molecular sieves, silica gels, activated carbon, activated alumina, and the like. Reference is made to "Zeolite Molecular Sieves" by Donald W. Breck (John Wiley & Sons, 1974) which describes the use and selection of zeolite adsorbents and which is incorporated herein by reference.

Zeolite 3A adsorbent, for example, may be used to adsorb ammonia from hydrocarbon streams after such stream has hydrodenitrified in a process which contains a processing step which is sensitive to nitrogen and its derivatives, such as a reforming operation. Similarly, Zeolite 5A adsorbent may be used to adsorb carbon monoxide or carbon dioxide in light gas operations such as ammonia synthesis or urea manufacture in which the presence of carbon monoxide and carbon dioxide is detrimental to the ammonia or urea formation catalysts. Activated carbon, for example, may be used to remove the condensibles from natural gas when membranes are used to separate methane from this gas which condensibles would be detrimental to the membrane.

Typical chemisorbents which may be utilized in the present invention include, but are certainly not limited to, zinc oxide, iron sponge, causticized alumina, impregnated carbons, chelating compounds, etc., and combinations thereof.

Typically, a chemisorbent such as zinc oxide or iron sponge may be employed for the sorption of hydrogen sulfide. Likewise, a chelating ion exchange resin such as a polystryene matrix containing imino-diacetate groups is particularly selective for copper, nickel, cobalt and iron. The utilization and selection of a particular chemisorbent for the selective removal of one or more components from a stream are well known to those skilled in the art and those conventionally used sorbents are all applicable here provided that they are capable of such selectivity at conditions which allow the feedstream to be in the vaporous state.

Depending upon the particular overall process and the sensitive processing step involved, the sorption bed will be designed to contain enough sorbent to remove substantially all of the at least one deleterious component or, alternatively, may allow a certain amount of breakthrough of deleterious component depending upon how much the sensitive step can tolerate, all of which can readily be determined by one skilled in the art.

It is understood, of course, that if the deleterious components in the feedstream are such that there is no one sorbent which will readily and selectively remove all of them, a combination of sorbents may be used, either in admixture in one sorbent bed or individually in a plurality of beds wherein the combined effect of these sorbents is capable of removing substantially all of the deleterious components. Thus, one adsorbent bed may be used in combination with a chemisorbent bed or, alternatively, two different types of adsorbents may be used, individually, or in combination, etc.

The decision to use an adsorbent as compared to a sorbent is generally one of economics. Generally, adsorbents are capable of being regenerated by means of a purge medium. For the most part, chemisorbents, which chemically react with the deleterious component as opposed to merely adsorbing such components, are not readily regenerable and therefore require frequent replacement. Consequently, if the amount of deleterious component contained within the feedstream is substantial, it is usually desirable to employ an adsorbent to remove such components from the stream. On the other hand, if the amount of deleterious component is relatively low, it may be more economical to utilize the chemisorbent, despite the fact that it needs to be replaced, so as to eliminate the capital and operating costs involved in running an adsorption bed. Such typical economic evaluations are conventionally carried out in the art and need not be discussed in detail here.

As noted earlier, the primary objective of the present invention is to eliminate the need for carrying out a plurality of phase changes on the processing stream in order to remove deleterious component and then integrate this removal step with the subsequent sensitive processing step. The present invention seeks to eliminate both capital and operating costs by maintaining the stream that is being processed in the vapor phase during the deleterious component removal step such that it can, if desired, immediately be introduced into the sensitive processing step while still in the vapor phase without the need for any phase change.

The ability to realize this objective is made possible by Applicant's further discovery that it is indeed possible to effectively utilize adsorbents, particularly zeolitic adsorbents, while the feed is in vaporous form at a high temperature despite the fact that it is well known to those skilled in the art that generally such adsorbents have low capacity for removing deleterious component at such high temperatures.

More specifically, when using an adsorbent to remove a deleterious component, the typical adsorption temperature has generally been in the range of from about 0° to 250° F., and usually from about 70° to 100° F. Correspondingly. the desorption temperature for regenerating such an adsorbent has generally been at a higher temperature, generally in the range of from about 450° to 700° F., and usually from about 500° to 600° F.

In complete contrast thereto, in the present invention, due to the fact that the stream is at elevated temperature in order to maintain such stream in the vapor phase, the temperature of adsorption in the present invention will be a temperature which is typical for conventional desorption temperatures, namely, about 150° to 750° F. and preferably from about 300° to 550° F.

Correspondingly, when the adsorbent is in the regeneration mode in the present invention, the desorption temperatures are such that they are at least equal to or greater than the temperatures that are utilized for adsorption in the present invention. Typical desorption temperatures are in the range of from about 450° to 800° F., and preferably from about 500° to 600° F.

As will be understood by one skilled in the art, the ability to desorb a deleterious component laden-adsorbent bed at a desorption temperature which is equal to the adsorption temperature is due to the fact there will be a large concentration gradient between the desorption medium and the deleterious component laden-adsorbent which enables the desorption of the deleterious component from the adsorbent into the desorption medium despite the fact that the same temperature is being used for both adsorption and desorption. Of course, the higher the desorption temperature, the more readily the desorption takes place.

Applicant has discovered that it is possible to use such high adsorption temperatures by frequently cycling the adsorbent from the adsorption mode to the desorption mode and then back again. Thus, conventionally, a typical adsorption mode in the prior art may comprise a time period of from about 8 to 24 hours. In the present invention, however, the adsorption mode lasts for only about 0.2 to 2.0 hours, preferably about 0.75 to 1.5 hours, before the bed is switched to the desorption mode. Generally, the bed is switched to the desorption mode before there is any breakthrough of deleterious component from the bed. However, depending upon the amount of deleterious component that the downstream sensitive processing bed can tolerate, a predetermined amount of breakthrough may be allowed before desorption takes place.

In the aggregate, the complete adsorption cycle, which comprises an adsorption period and a desorption period, is in the range of from about 0.4 to 4.0 hours, preferably about 1.5 to 3.0 hours.

As to the chemisorbents which may be employed in the present invention, inasmuch as they generally tend to have better loading at elevated temperatures, there are no special requirements that need be utilized when carrying out the sorption step with a chemisorbent. The chemisorbents will typically be desirable when the deleterious component concentration is relatively low, generally about 0.5 to 50 ppm by weight, and more preferably about 1 to 20 ppm by weight. Although chemisorbent may certainly be employed when the deleterious component concentration is higher, it may not be economically advantageous to do so if the cost of replacement of such chemisorbent exceeds the cost of operating a regenerable adsorbent which may be used instead.

The length of time before an adsorbtion bed is switched to the desorption phase and vice versa is dependent upon the particular adsorbent, the deleterious component(s), the capacity of the adsorbent and the adsorption conditions which, in the preferred embodiment of the present invention, will be substantially similar to the conditions existing in the downstream sensitive processing step.

The desorption of the deleterious component laden-bed may be carried out at the desorption temperatures noted above with any desorption medium which is inert to the adsorbent material and to the remaining constituents of the stream being processed and which has a low concentration of the deleterious component such that it is capable of desorbing such deleterious component from the adsorbent even if the desorption temperature is similar to the adsorption temperature.

In a preferred embodiment of this invention, as will be discussed more fully hereinbelow, the product stream leaving the sensitive processing step is utilized, in whole or in part, as the purge medium.

From sorption bed 504, a sorption effluent is provided containing a reduced concentration of deleterious component. This sorption effluent enters line 440 and is ultimately passed to the downstream sensitive processing step shown diagramatically in FIG. 1 as 505.

It should be noted that although the description of the embodiment shown in FIG. 1 has thus far indicated that the stream that is being processed is transferred from one operation to the next as shown in the drawing, it is not essential to the present invention that the stream be processed precisely in this manner, one step after the other. Thus, it is certainly possible for the processing stream to be treated by one or more steps between any of the processing steps shown and described in FIG. 1. Although it would certainly be desirable to immediately pass the sorption effluent from sorption bed 504 to sensitive processing step 505 in order to take advantage of the present invention wherein the stream is maintained in the vapor phase and so treated in the sensitive processing step, there is no objection to carrying out a process step between the sorption bed and the sensitive processing step which still, however, maintains the stream in such a vapor phase.

Sensitive processing step 505 is one which is sensitive to the deleterious component being removed by sorption bed 504 and is a sensitive processing step which is carried out in the vapor phase. The conditions of such sensitive processing step, namely temperature and pressure, are preferably but not necessarily substantially similar to the temperature and pressure conditions contained within sorption bed 504 thereby enhancing the facilitation of transferring the vaporous stream from the adsorption step to the sensitive processing step.

Sensitive processing step 505 may comprise a chemical reaction, with or without a sensitive-type catalyst; a non-regenerable sorbent or an adsorbent; an ion exchange resin; a membrane separation unit; or the like.

After the sorption effluent is subjected to the sensitive processing, a product effluent stream is produced at line 450.

Figure 2:
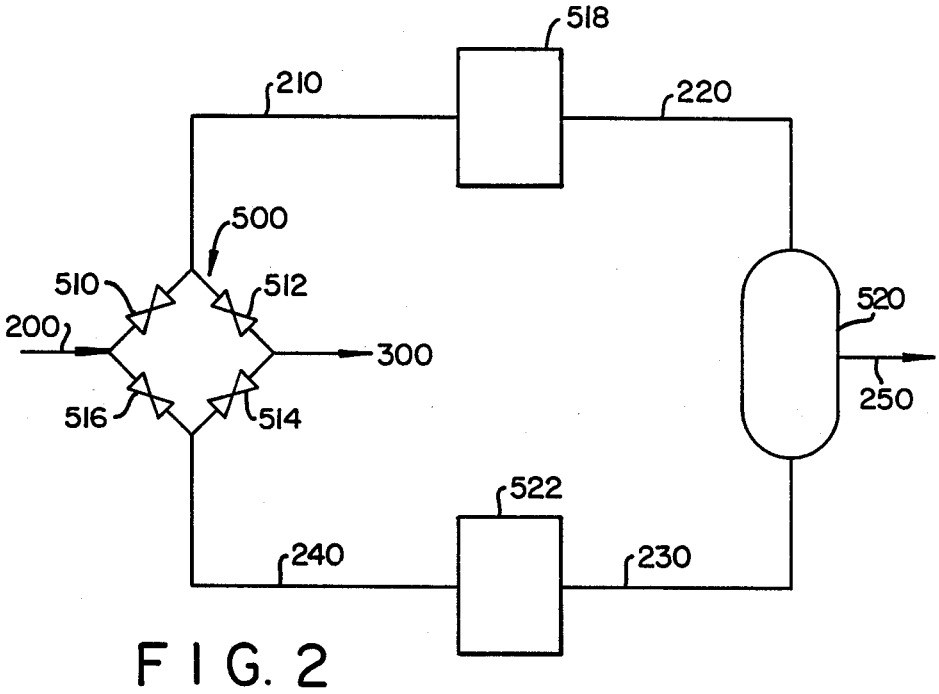
FIG. 2 is a schematic flow sheet of the preferred embodiment of the present invention showing two adsorbers and a processing step which is sensitive to a stream component in which the product effluent is used as a purge medium for the adsorbent on the desorption mode, including a valve control scheme which enables the cycling of the adsorbent beds.

Turning now to FIG. 2, the preferred embodiment of the present invention is depicted in which all or part of the product effluent leaving the sensitive processing step is utilized as a purge medium for a deleterious component laden adsorbent.

More particularly, just as in FIG. 1, the schematic diagram of FIG. 2 depicts this preferred embodiment of the present invention in its most simplified version and represents just one portion of an overall chemical process which contains a processing step which is sensitive to one or more components present in the stream to be processed, a fluid feedstream containing at least one component which is detrimental to the at least one processing step within the process, and at least one component which is to have a processing operation performed on it in the sensitive processing step entering line 200.

As in the case of FIG. 1, the fluid stream may be the feedstock to the overall chemical process which already contains the deleterious component or, alternatively, this fluid feedstream may be an intermediate stream in the overall process which has already been treated by one or more processing steps in which a deleterious component has been generated. In either case, this stream, prior to being introduced to the sensitive step, must be treated so as to remove the one or more deleterious components.

After entering line 200, the stream then enters valve assembly 500. In valve assembly 500, valves 510 and 514 are open and valves 512 and 516 are closed. The fluid stream containing the deleterious components then passes through open valve 510 into line 210 and enters adsorbent bed 518.

Adsorbent bed 518 contains an adsorbent which is selective for the one or more deleterious components contained within the stream as compared to the remaining stream constituents.

The adsorption mode is carried out at temperature and pressure conditions which maintain the fluid stream in the vapor phase. Preferably, these adsorption conditions are substantially similar to the conditions in the sensitive processing step.

From adsorbent bed 518, an adsorption stage effluent is provided containing a reduced concentration of deleterious component. This adsorption stage effluent enters line 220 and ultimately is passed through the sensitive processing step shown diagrammatically in FIG. 2 as 520.

After the adsorption stage effluent is subjected to the sensitive processing step, a product effluent stream is produced. At least a portion of this product effluent stream enters line 230 with the remainder leaving at line 250. Enough of the product effluent stream enters line 230 so that it can effectively be used as a purge medium to eventually regenerate adsorbent bed 522 which is in the desorption mode and is laden with a deleterious component from a previous adsorption phase.

Although not shown in FIG. 2, the sensitive processing step may also produce secondary or waste effluent streams, the production of which is not the objective of the overall process which is to produce the product effluent stream containing the component which was present in the feed stream and upon which an operation was preformed in the sensitive processing step which component may be present per se in a more purified form or as a reaction product thereof. Thus, in a reforming operation, it is the reformate which is the product effluent stream and which, according to this preferred embodiment of the invention, is utilized as the purge medium for the spent adsorbent bed. Similarly, in an isomerization reactor, it would be the isomerate which acts as the regenerating medium for the spent adsorbent. Accordingly, as used herein, the product effluent stream is that stream which contains the component originally present in the feedstream and upon which an operation is performed in the sensitive processing step or which contains a reaction product of such component, the production of which is the objective of the overall process. In this preferred embodiment of the present invention, it is this product effluent stream, all or a portion thereof, which is used as the desorption medium for the spent adsorption bed.

The desorption is carried out under desorption conditions which enables deleterious component to effectively be removed from the adsorbent and thereby regenerate the adsorbent for further use. As noted earlier, the desorption temperature will generally be equal to or greater than the temperatures that are employed for adsorption.

Generally, if the product effluent stream is immediately contacted with the adsorbent to be regenerated, the temperature of the stream will usually be sufficient to provide the desorption temperature inasmuch as the sensitive processing step typically is carried out at elevated temperatures. However, if there are intervening steps carried out between sensitive processing step 520 and adsorbent bed 522 or, alternatively, the temperature is not high enough, heating means (not shown) may be employed to raise the temperature of the product effluent stream to the proper desorption temperature.

The optimum operating conditions for both the adsorption and desorption phases in conjunction with the corresponding cycle times can readily be determined by those skilled in the art keeping in mind that the stream is to be in and maintained in the vapor phase during adsorption, and preferably, the adsorption conditions are the same as the conditions for the sensitive processing step.

After adsorbent bed 522 is regenerated, a desorption stage effluent containing an increased concentration of deleterious component leaves this bed via line 240 and enters valve assembly 500 through valve 514 and then enters line 300 either as product or to continue to be further processed in the overall chemical process.

After a length of time, adsorbent bed 518 is laden with deleterious component and adsorbent bed 522 is regenerated. At this point, the valves in valve assembly 500 are adjusted such that valves 510 and 514 are closed and valves 512 and 516 are opened. In this manner, the flow of feedstream 200 is now reversed through the system such that it flows through line 240 into adsorbent bed 522 for adsorption of deleterious component and then into sensitive step 520. The adsorption effluent leaving sensitive processing step 520 is then used as a purge medium to regenerate bed 518. The stream ultimately leaves the system through valve 512 and line 300.

Figure 3:
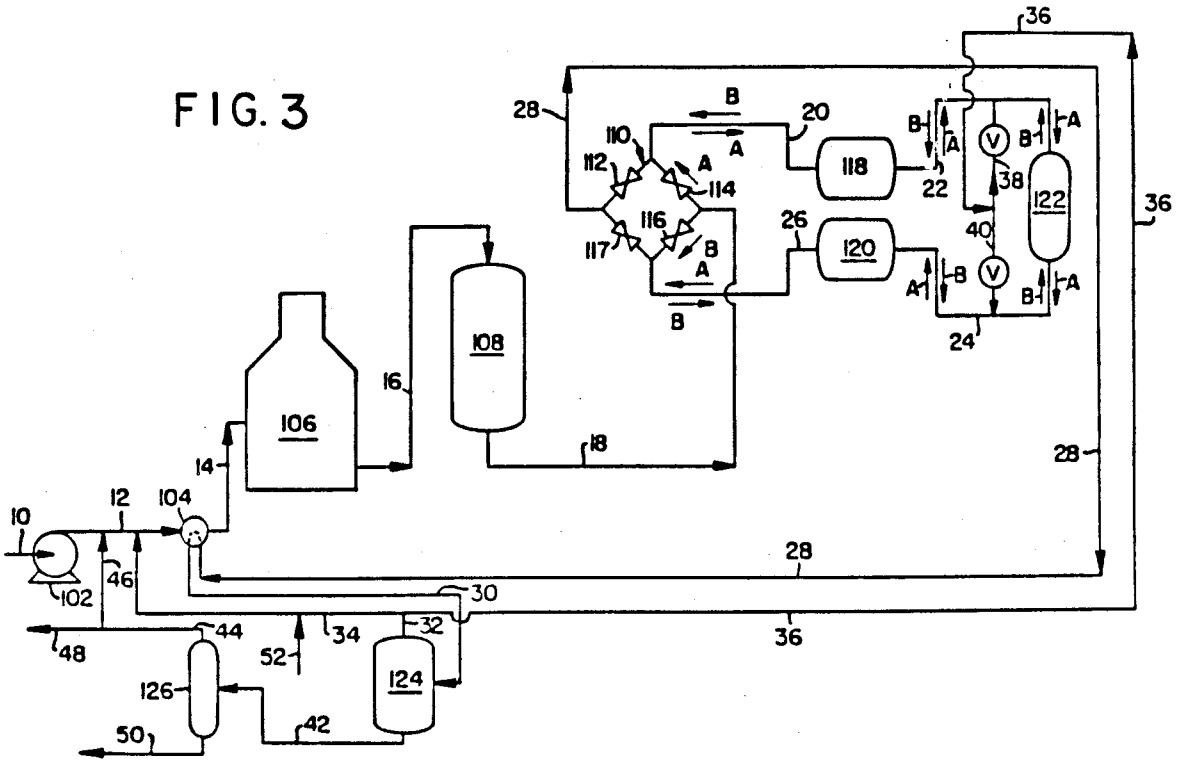
FIG. 3 is a schematic flow sheet of another preferred embodiment of the present invention wherein a hydrocarbon feedstream is subjected to an isomerization step and in which an adsorbent is utilized to remove the sulfur and nitrogen bearing compounds from hydrocarbon feedstream, which adsorbent beds are regenerated by the product effluent.
Figure 4:
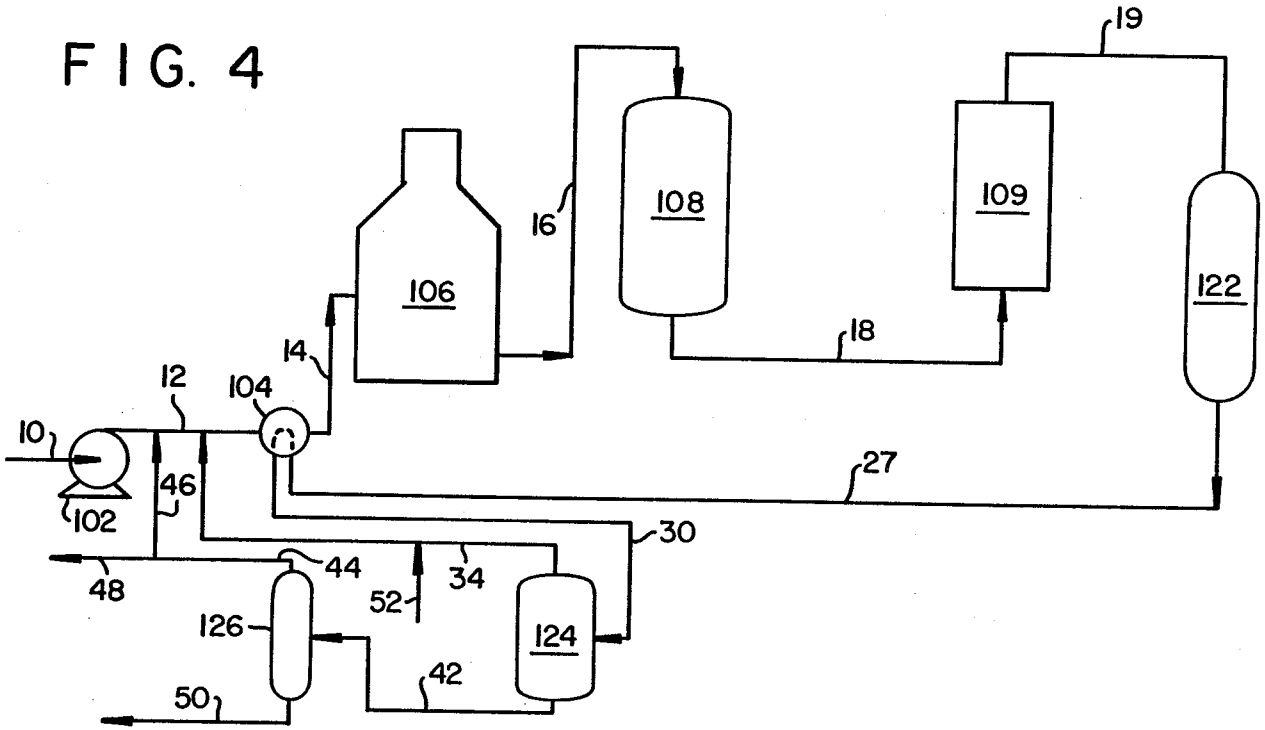
FIG. 4 is a schematic diagram showing an alternative embodiment of that shown in the FIG. 3 where in lieu of using an adsorbent to remove the deleterious component, a chemisorbent is used instead.

While the following discussion will feature an isomerization process which is a preferred embodiment of the present invention, as shown in FIGS. 3 and 4, it is understood, as discussed above, that the present invention is in no way limited to such an embodiment.

Referring now to FIGS. 3 and 4 in which the same numerals are used to designate similar items, a liquid hydrocarbon feed stream containing sulfur, sulfur bearing compounds, nitrogen, and/or nitrogen bearing compounds is introduced through line 10 to pump 102 where it is first pumped to heat exchanger 104 via line 12.

In this isomerization process, the hydrocarbon feedstream usually contains at least four carbon atoms and is typically light straight run gasoline or light naphthas, natural gasolines, light hydrocrackate, or light reformate, which generally contain about 0 to 400 ppm of sulfur and 0–100 ppm, usually 0–10 ppm, of nitrogen bearing compounds. In general, however, the composition of the feed stream is not critical to the present invention as long as the sorbent is capable of selectively removing the hydrogen sulfide and/or ammonia from the remaining constituents of the hydrocarbon feed stream.

In heat exchanger 104, the feed stream is generally heated to a temperature in the range of from about 200° to 500° F., and preferably about 300° to 450° F., before being introduced to heater 106 via line 14.

Heater 106 heats the hydrocarbon feed stream to the extent that there is phase change and the feed is converted to a vapor, which is reguired for the subseguent processing steps. Generally, the gaseous feed leaving heater 106 is at a temperature in the range of from about 500° to 650° F., and preferably about 550° to 600° F. and at a pressure of about 200 to 700 psi. Heater 106 is well known in the art and is conventionally utilized in a typical hydrodesulfurization/isomerization process.

From heater 106, the vaporous feed is conveyed via line 16 to hydrotreating reactor 108 in which essentially all of the sulfur and sulfur bearing compounds and nitrogen and nitrogen bearing compounds contained within the hydrocarbon feed stream are converted to hydrogen sulfide and ammonia, respectively, by reacting with hydrogen in the presence of a catalyst suitable for such purpose. Such a hydrotreating reaction is also well know to those in the art, is conventionally used in the typical hydrotreating/isomerization process, and is discussed in, for example, U.S. Pat. No. 4,533,529, the contents of which are incorporated herein by reference. Generally, the hydrogenation of the sulfur and nitrogen compounds within reactor 108 is carried out at a temperature of from about 500° to about 650° F. depending on the conditions and the source of hydrogen chosen. Useful catalysts are those containing metals of Groups VB, VIB, VIII and the Rare Earth Series of the Periodic Table defined by Mendeleff, published as the "Periodic Table of the Elements" in Perry and Chilton, *Chemical Engineers Handbook*, 5th Edition. The catalysts may be supported or unsupported, although catalysts supported on a refractory inorganic oxide, such as on a silica, alumina or silica-alumina base are preferred. The preferred catalysts are those containing one or more of the metals colbalt, molybdenum, iron, chromium, vanadium, thorium, nickel, tungsten (W) and uranium (U) added as an oxide or sulfide of the metal. Typical hydrotreating catalysts include Shell 344 Co/Mo (Shell Chemical Co., Houston, Tex.), C20-5, C20-6, C20-7, C20-8 Co/Mo hydrotreating catalysts (United Catalysts, Inc., Louisville, Ky.), and the like.

After the sulfur and/or nitrogen in the hydrocarbon feed stream is converted to hydrogen sulfide and ammonia, respectively, the stream exits reactor 108 via line 18 at substantially the same temperature as it entered.

In the specific embodiment shown in FIG. 3, an adsorption bed is utilized to remove the hydrogen sulfide and ammonia from the stream in which embodiment product effluent from the sensitive processing step is used as the desorption medium. Alternatively, in the specific embodiment shown in FIG. 4, a chemisorbent bed is utilized for the removal of deleterious component.

Referring now to FIG. 3, the stream from line 18 is introduced into at least one hydrogen sulfide/ammonia adsorption zone via valve assembly 110. Valve assembly 110 is reguired so that it is possible to properly control the flow of the hydrocarbon feed stream to adsorber beds 118 and 120 in a manner which will allow either adsorption or desorption, depending upon whether the feed stream flows cocurrently or countercurrently through the adsorption beds.

It is noted that although the minimum of only two beds (118 and 120) are shown in the drawing, any number of additional beds may be utilized for the adsorption/desorption part of this process.

Generally, assuming that adsorption bed 118 has just been regenerated and is now ready for adsorption again, the path that the hydrocarbon feed stream would follow is shown by the arrows labelled "A" in the drawing. Valves 114 and 117 in the valve assembly would be in the open position whereas valves 112 and 116 would be closed. The hydrocarbon feed stream containing the hydrogen sulfide and/or ammonia would travel past valve 114, to line 20 and then to adsorption bed 118 in which it passes through cocurrently and hydrogen sulfide and/or ammonia contained within the feedstream is selectively removed by the adsorbent. The temperature of adsorption is in the range of from about 200° to 500° F., preferably about 300° to 450° F. at a pressure of about 10 to 30 atm.

The treated hydrocarbon feedstream, now having essentially all of its hydrogen sulfide and ammonia removed, is then passed through line 22 to isomerization reactor 122 in which the N-carbons are converted to their corresponding isomers in order to obtain higher octane values and form a hydrocarbon product-containing effluent, and more specifically, an isomerate. The temperature and pressure conditions within the isomerization reactor include a range of from about 450° to 550° F., preferably 475° to 525° F. at pressures of about 10 to 30 atm.

The isomerate is passed via line 24 to adsorbent bed 120 which is laden with hydrogen sulfide and/or ammonia from a previous adsorption cycle and which is now swept with the hydrocarbon product effluent in a countercurrent manner to regenerate bed 120 and to once again contain essentially all of the starting hydrogen sulfide and/or ammonia content. The temperature and pressure conditions for desorption include a temperature in the range of from about 450° to 700° F., preferably 500° to 600° F. at pressures of about 10 to 30 atm.

The hydrogen sulfide and/or ammonia laden hydrocarbon product effluent stream then enters valve assembly 110 once again via line 26 and passes through valve 117 to line 28.

As was noted earlier, it is not necessary in the process of the present invention that the adsorption effluent immediately be introduced to the sensitive processing step (in this embodiment, the isomerization reaction), or that the effluent leaving the sensitive processing step immediately be used to desorb an adsorption bed. Thus, in the embodiment of FIG. 3, it may be desirable to first pass the adsorption effluent from adsorption bed 118 through a guard bed (not shown) containing zinc oxide, for example, to remove any traces of hydrogen sulfide that may still be present prior to having this stream enter the isomerization reactor. So too, after leaving the isomerization reactor, but before entering adsorption bed 120 for desorption thereof, the isomerate may first desirably be passed through a separator (not shown) such as a molecular sieve adsorbent, and the like, to separate the isomers from the normal hydrocarbons that were not isomerized. The isomer stream may then be utilized to regenerate adsorption bed 120 while the normal hydrocarbons stream would advantageously be recycled back to the isomerization reactor for further processing.

After the adsorption cycle is completed and generally well before there is any hydrogen sulfide and/or ammonia breakthrough in the adsorption bed, the beds that are on the adsorption mode are switched to desorption and the beds that are on desorption are switched to adsorption. As mentioned earlier, due to the fact that the hydrogen sulfide/ammonia adsorbents are being utilized at high temperatures, which temperatures in the past have been used only for desorption, the capacity of these adsorbents is relatively low. Conseguently, in order to still be able to use these adsorbents, the cycle times must be relatively short and an adsorbent bed can remain on the adsorption mode generally for about 0.5 to 6.0 hrs, preferably for about 1.0 to 2.0 hours. Once the adsorption cycle is complete and it is time for bed 118 to be desorbed and bed 120 to start the adsorption mode, as a result of opening valves 112 and 116 and simultaneously closing valves 114 and 117, respectively, the path of the feedstream now generally follows that shown by arrow "B" in the drawing, reversing its direction of flow through the adsorption zones and isomerization reactor to thereby flow cocurrently through bed 120 which is now on adsorption and countercurrently through bed 118 which is now on desorption.

Although this embodiment shows the reversal of feed flow through the isomerization reactor 122 as a result of cycling the adsorption beds, it is understood that the present invention also encompasses the embodiment where the flow of the hydrocarbon feedstream is continuous in one direction through the reactor 122 by means of proper arrangement of additional valves (not shown).

The hydrogen sulfide/ammonia adsorbent that is used in the adsorption beds must be capable of selectively adsorbing hydrogen sulfide and/or ammonia from the hydrocarbon stream and be able to withstand the temperature and pressure conditions existing within the adsorption beds.

Although the temperatures within the adsorption zone are substantially similar to those in the isomerization reactor, it may still be desirable to heat the hydrogen sulfide and ammonia free hydrocarbon feedstream prior to introducing it into the reactor so as to further facilitate the proper isomerization reaction temperature.

Any adsorbent may be used in this embodiment as long as it is capable of selectively removing hydrogen sulfide and/or ammonia from the remaining constituents of the stream. The adsorbents which are particularly suitable in the process of this preferred embodiment of the present invention and which are capable of providing good hydrogen sulfide and/or ammonia removal at the high temperatures employed in the adsorption cycle are 4A zeolite molecular sieve and clinoptilolite.

The term "zeolite", in general, refers to a group of naturally occurring and synthetic hydrated metal alumino-silicates, many of which are crystalline in structure. There are, however, significant differences between the various synthetic and natural materials in chemical composition, crystal structure and physical properties such as X-ray powder diffraction patterns.

The structure of crystalline zeolite molecular sieves may be described as an open three-dimensional framework of $SiO_4$ and $AlO_4$ tetrahedra. The tetrahedra are crosslinked by the sharing of oxygen atoms, so that the ratio of oxygen atoms to the total of the aluminum and silicon atoms is egual to two. The negative electro valence of tetrahedra containing aluminum is balanced by the inclusion within the crystal of cations, for example, alkali metal and alkaline earth metal ions such as sodium, potassium, calcium and magnesium ions. One cation may be exchanged for another by ion exchange techniques.

The zeolites may be activated by driving off substantially all of the water of hydration. The space remaining in the crystals after activation is available for adsorption of adsorbate molecules. This space is then available for adsorption of molecules having a size, shape and energy which permits entry of the adsorbate molecules into the pores of the molecular sieves.

Zeolite 4A is the sodium cation form of zeolite A and has pore diameters of about 4 angstroms. The method for its preparation and its chemical and physical properties are described in detail in U.S. Pat. No. 2,882,243, which is incorporated herein by reference.

Other adsorbents which are also applicable in this preferred embodiment of the present invention include those adsorbents which have a pore size of at least 3.6 angstroms, the kinetic diameter of hydrogen sulfide. Such adsorbents include zeolite 5A, zeolite 13X, activated carbon, and the like. Such adsorbents are well know in the art and are conventionally used for hydrogen sulfide/ammonia adsorption, albeit at much lower temperature than that used in this preferred embodiment.

As a precautionary measure, as noted earlier, it may be desirable to add a small conventional, zinc oxide guard bed (not shown) immediately after the adsorption zones and prior to the isomerization reactor to ensure against the possibility of any hydrogen sulfide residual breakthrough or a system upset.

The isomerization reactor 122 is a conventional isomerization reactor well known to those skilled in the art containing a catalytically effective amount of isomerization catalyst to provide the hydrocarbon effluent with enhanced isomer concentration. Generally, the temperature of the effluent leaving the reactor is somewhat higher than it was entering, about 5° to 40° F. higher. As a result of this temperature rise and the pressure drop across the reactor, the efficacy of the effluent as a purge gas is enhanced.

Although in this preferred embodiment, the sulfur and nitrogen sensitive processing step is the catalyst contained within the isomerization reactor, this embodiment of the present invention is applicable to any sulfur and/or nitrogen sensitive processing step wherein the sulfur and nitrogen, in the form of hydrogen sulfide and ammonia, respectively, are adsorbed by the cyclic adsorption system described above. Thus, a catalytic reformer, which also employs a catalyst which is sensitive to sulfur and nitrogen, could very well be substituted for the isomerization reactor shown in FIG. 3 and the benefits of the present invention would equally be realized.

The product effluent now containing hydrogen sulfide and/or ammonia then passes via line 28 to be cooled in heat exchanger 104 and is then introduced via line 30 into separator 124. In separator 124, an overhead of excess molecular hydrogen and a liquid hydrocarbon isomerate condensate are produced. The hydrogen leaves separator 124 via line 32 and is then split into two streams via lines 34 and 36.

Line 34 provides hydrogen recycle to the feed at line 12 so as to have a stoichiometric excess of molecular hydrogen for the hydrogen sulfide and ammonia forming reactions. Additional makeup hydrogen may be provided via line 52.

Line 36 provides hydrogen, as a further embodiment of the present invention, which is combined via line 38 or line 40, respectively, with the isomerate to enhance the subseguent desorption step. Generally, about 0% to about 50 mole % of hydrogen is added to the hydrocarbon effluent.

The condensed hydrocarbon isomerate product leaving separator 124 is then introduced to stabilizer 126 via line 42. In stabilizer 126, the hydrocarbon isomerate is flashed so as to remove essentially all of the hydrogen sulfide and/or ammonia it contains as well as light end products such as $C_1$ to $C_4$ gases which leave the stabilizer as overhead via line 44. A portion of this overhead is recycled to the feed at line 12 via line 46 and the remainder is removed from the system via line 48. The final isomerate product is removed from stabilizer 126 via line 50.

Now turning more specifically to the embodiment shown in FIG. 4, in which a chemisorbent is used in sorption bed 109, after leaving reactor 108 in which the sulfur and/or nitrogen in the hydrocarbon feedstream is converted to hydrogen sulfide and ammonia, respectively, the stream exits reactor 108 via line 18 and is introduced to sorption bed 109.

Generally, as noted earlier, a chemisorbent is advantageously employed when the hydrogen sulfide content is in the range of from 0 to 25 ppm.

In this embodiment of the present invention, the temperature of sorption by the chemisorbent will be substantially similar to the temperature and pressure conditions in the isomerization reactor which were noted above.

Chemisorbents that are suitable for use in sorption bed 109 which chemically react with the sulfur and nitrogen compounds rather than merely physically absorb them as do the physical adsorbents discussed above include, but are not limited to, zinc oxide; iron sponge; causticized alumina; impregnated carbon, such as carbon impregnated with iodine or metallic cations; as well as Zeolite A, Zeolite X or Zeolite Y, all of which have been ion exchanged with either zinc, copper or iron cations; and chelating compounds such as metal complexes and the like. Preferably, zinc oxide is utilized as the chemisorbent in this embodiment of the present invention.

Generally, these chemisorbents are not readily regenerable and must be discarded and replenished when they are laden with the sulfur and nitrogen compound material. Obviously, these chemisorbents must be able to also selectively remove sulfur compound impurities from the hydrocarbon stream that is being processed herein.

After leaving sorption bed 109, the sorption effluent, now containing a reduced concentration of sulfur and nitrogen components enters isomerization reactor 122 and is treated in the manner discussed above with respect to the embodiment shown in FIG. 3. The product effluent leaving isomerization reactor 122 now enters line 27 to be cooled in heat exchanger 104 and is then processed in a manner similar to that described with respect to FIG. 3. In this alternative embodiment, stabilizer 126 would be utilized to remove any remaining hydrogen sulfide and/or ammonia that may still be contained within the product and/or utilized to remove any light end product such as $C_1$ to $C_4$ gases that may be contained within the product effluent, as well.

Figure 5A:
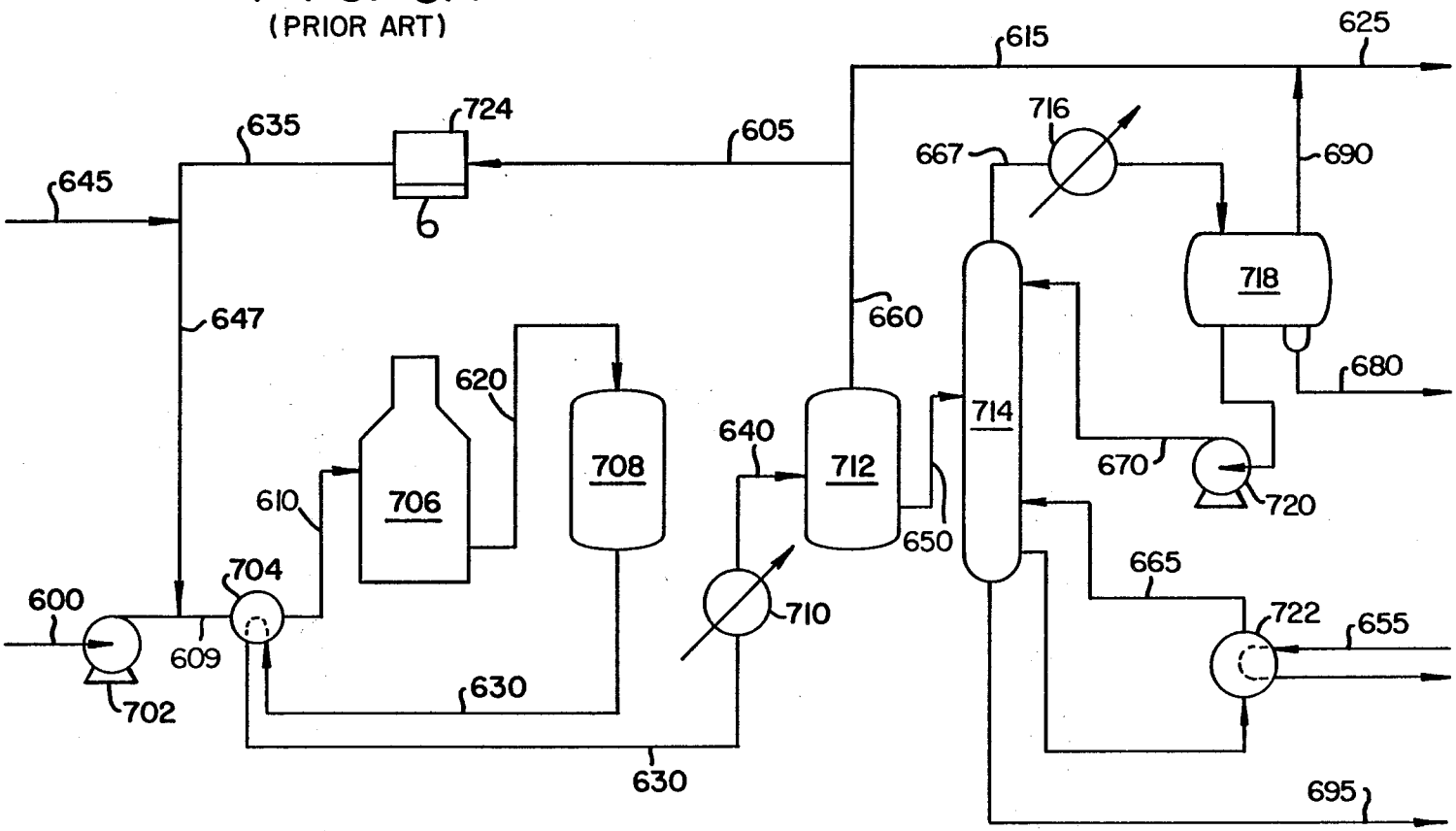
FIG. 5A (PRIOR ART)
FIG. 5*a* is not in accordance with the present invention and represents a schematic diagram of the prior art showing a conventional hydrodesulfurization process.
Figure 5B:
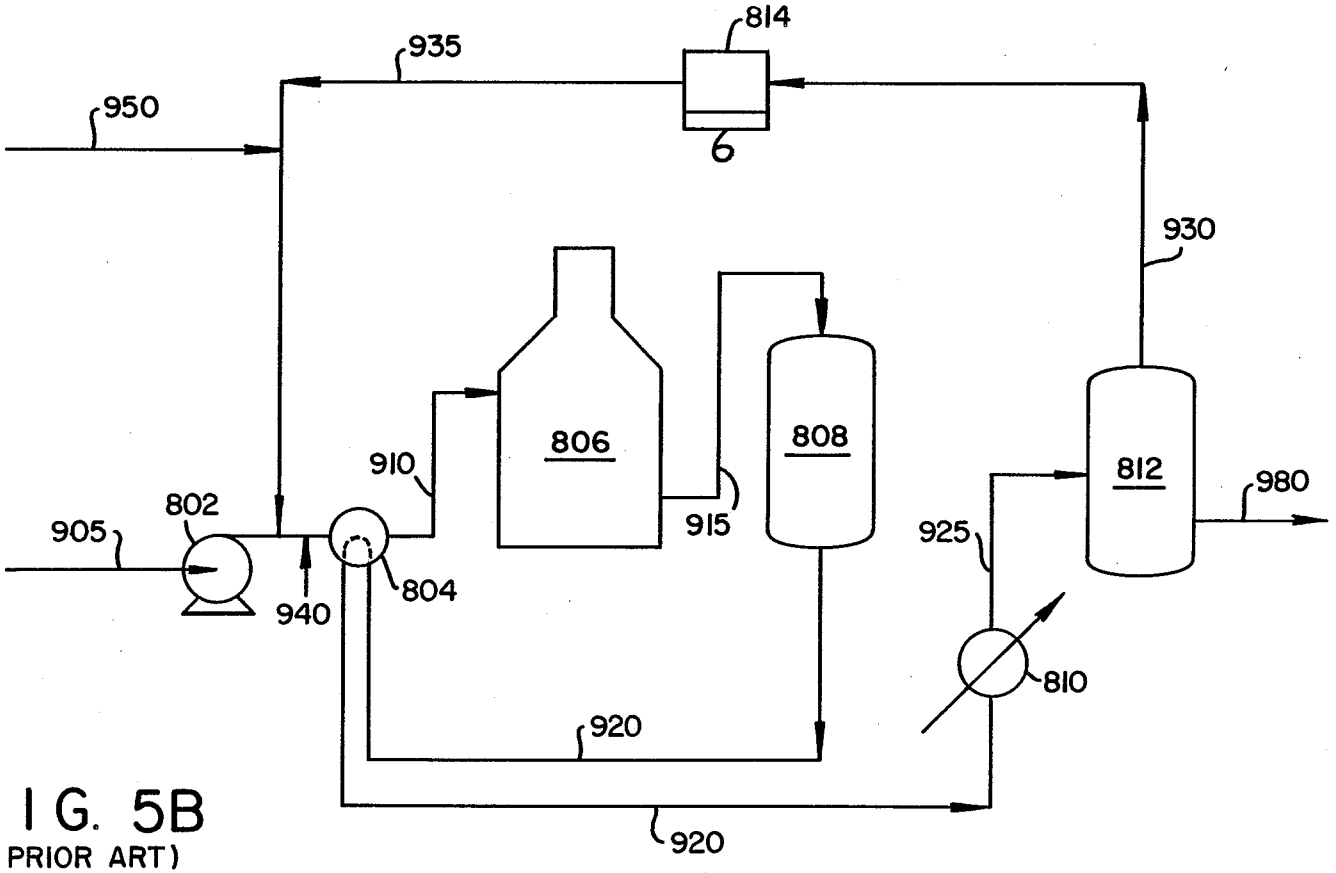
FIG. 5B (PRIOR ART)
FIG. 5*b* is also not in accordance with the present invention and represents prior art showing a schematic diagram of a conventional isomerization process.

For comparison purposes, FIGS. 5*a* and 5*b* set forth a conventional hydrodesulfurization/isomerization process which is not in accordance with the present invention. FIGS. 5*a* and 5*b* have been included to vividly demonstrate the savings in both capital and operating costs which the present invention is able to realize. The schematic diagrams of FIGS. 5*a* and 5*b* have been taken from Petroleum Refining Technology and Economics, by James H. Gary, et al. (Marcel Dekker, Inc., 1975), the contents of which are incorporated herein by reference.

Briefly, FIG. 5*a* sets forth the conventional prior art technique for hydrodesulfurizing a typical hydrocarbon stream containing sulfur and/or nitrogen components. The hydrocarbon stream is introduced via line 600 into pump 702 which pumps the stream via line 609 through heat exchanger 704 into heater 706 via line 610 to convert the hydrocarbon stream to a vapor phase. The vaporous hydrocarbon stream is then fed to converter 708 via line 620 in order to convert the sulfur compounds to hydrogen sulfide and the nitrogen compounds to ammonia, respectively.

After passing through heat exchanger 704 via line 630, the hydrocarbon stream, now containing hydrogen sulfide and/or ammonia, must then be condensed with cold water in condenser 710 to produce a liguid hydrocarbon stream such that it is in a form applicable for the removal of the hydrogen sulfide and nitrogen.

The liquid hydrocarbon stream enters hydrogen separator 712 via line 640 wherein $C_3$ and lighter components are removed via lines 660, 615 and 625, respectively, and wherein hydrogen is recycled via lines 660 and 605. The hydrogen recycle is compressed by compressor 724 and then enters line 635 with hydrogen makeup from line 645 to enter line 647 to be ultimately recycled to heater 706 and converter 708.

The liquid hydrocarbon, now having had the lighter components and hydrogen removed, is then introduced to steam stripper column 714 in which the hydrogen sulfide and ammonia components are removed. Steam stripper 714 also includes a reboiler 722 in which liquid hydrocarbon material from steam stripper 714 is vaporized by means of steam or hot oil entering the reboiler via line 655. Similarly, vapors leaving steam stripper column 714 via line 667 are condensed in condenser 716 by cold water and then passed through a separator 718 in which sour water leaves via line 680 and condensate is pumped by means of pump 720 through line 670 to be returned back to the column. $C_3$ and lighter components are removed via lines 690 and 625. A liquid hydrocarbon product having its sulfur and nitrogen components removed leaves the steam stripper via line 695.

This liquid hydrocarbon product is then introduced into the second phase of the conventional prior art technique which is the isomerization process. In this process, the hydrocarbon stream enters line 905 to be pumped by pump 802 through line 940 and heat exchanger 804 into heater 806 by means of line 910. In heater 806, the hydrocarbon feed is once again converted to the vapor phase and is then passed to isomerization reactor 808 via line 915. The isomerate product is then passed through line 920 and heat exchanger 804 to be condensed by condenser 810 and then passed through line 925 into hydrogen separator 812 in which final product is removed via line 980.

A hydrogen recycle stream is passed through line 930 and condensed by compressor 814 to be recycled via line 935 back to the isomerization process. A hydrogen makeup stream is provided in line 950.

As is vividly demonstrated by FIGS. 5*a* and 5*b* (which are not in accordance with the present invention but constitute the conventional practice of the art), as compared to FIGS. 3 and 4 which are in accordance with the present invention, it is clearly seen that in this preferred embodiment of the process of the present invention, which involves a hydrodesulfurization/isomerization process, the present invention clearly enables the integration of what used to be two separate processing loops, i.e., the hydrodesulfurization loop and the isomerization loop, into one economical and efficient process which substantially reduces and/or eliminates much of the processing eguipment that is reguired in the prior art. Moreover, by not having to continuously convert the hydrocarbon stream from one phase to the other, the efficiency of the integrated overall process of the present invention is also dramatically improved.

Specifically, by integrating the hydrodesulfurization and isomerization loops of the prior art, at least a furnace, a heat exchanger, a recycle compressor, a hydrogen separator, a feed pump, a product cooler, and a stream stripper including its corresponding condenser and reboiler have all been eliminated. So too, by the process of the present invention, the hydrocarbon stream remains in the vapor phase once it is converted to that phase and stays in that phase until it has been introduced and subjected to the sensitive processing step resulting in an efficient and economical processing system.

The fluid stream that is suitably treated in the preferred embodiments of the present invention is not critical with respect to its origin, its constituent molecular species or its relative proportions of those molecular species within the feedstock. Thus, the fluid stream may be a hydrocarbon stream resulting from the destructive hydrogenation of coal or it may be obtained from deposits of natural gas or petroleum. Sulfur-containing condensates from natural gas, i.e., the LPG compositions rich in propanes and butanes, are also well suited to the present process as are natural gasolines and relatively light petroleum fractions boiling between about −44° to about 180° F. which are mostly comprised of $C_3$ to $C_6$ hydrocarbons. Moreover, liquid or liquifiable olefin or olefin containing streams, such as those used in alkylation processes, contain propylene, butylene, amylene, and the like, are also suitably utilized.

Generally, the sulfur compound impurities present in these feedstreams comprises at least one but ordinarily a mixture of two or more of hydrogen sulfide, the mercaptans such as ethyl mercaptan, n-propyl mercaptan, isopropyl mercaptan, n-butyl mercaptan, isobutyl mercaptan, t-butyl mercaptan, and the isomeric forms of amyl and hexyl mercaptan, the heterocyclic sulfur compounds such as thiophene and 1,2-dithiol, and aromatic mercaptans exemplified by phenyl mercaptan, organic sulfides generally and carbonyl sulfide, and the like.

Although the adsorbent which is particularly suitable in the process of the present invention is crystalline zeolitic molecular sieves, which have been discussed earlier, other adsorbents, as noted above, are also applicable.

Activated alumina, which is also suitable is a porous form of aluminum oxide of high surface area. It is capable of selective physical adsorption in many applications and is chemically inert to most gases and vapors, nontoxic and will not soften, swell or disintegrate when immersed in water. High resistance to shock and abrasion are two of its important physical characteristics. The adsorbed material may be driven from the activated alumina by suitable choice of reactivating temperature, thus returning it to its original adsorptive form.

Activated alumina may be reactivated to its original adsorptive efficiency by employing a heating medium at any temperature between 250° F. and 600° F. For thorough regeneration, the temperature of the regenerating gas on the exit side of the bed should reach at least 350° F.

Silica gel is a granular, amorphous form of silica, made from sodium silicate and sulfuric acid. Silica gel has an almost infinite number of sub-microscopic pores or capillaries by which it can act as a selective adsorbent depending upon the polarity and molecular size of the constituents within the fluid feedstream that is being treated.

The use of such physical adsorbents as well as adsorbents such as activated carbon, and the like, are well known to those skilled in the art and their selection, operating conditions and regenerating conditions are easily ascertainable to those skilled in the art.

EXAMPLES

EXAMPLE 1

A hydrocarbon feed containing 70 ppmw of sulfur (contained as a variety of sulfur bearing compounds) and 3 ppmw of nitrogen (contained as a variety of nitrogen bearing compounds) is to be isomerized. A feed quantity of 40 cc/min at a density of 0.65 g/cc (equivalent to 26 g/min) is introduced into a hydrotreating bed loaded with 300 grams of C20-8 Co/Mo hydrotreating catalyst, yielding a weight hourly space velocity (WHSV) of 5.2 for the hydrotreating reaction.

The stream, now containing hydrogen sulfide and ammonia, is then fed into an adsorber loaded with 400 grams of Zeolite 4A having a pore channel diameter of approximately 4 angstroms. A highly sensitive gas chromatagraph capable of resolving sulfur to below 0.1 ppmv is utilized to monitor the path of sulfur in the system. Sample taps are placed on the inlet and the exit of the adsorber beds.

The stream then enters an isomerization reactor after being heated to a temperature of 500° F. The isomerization reactor contains 945 grams of HS-10, an isomerization catalyst (Union Carbide Corporation, Danbury, CT), which results in a WHSV of 1.65 weight of feed/weight of catalyst per hour. The isomerate leaving the reactor at a temperature of 500° F. then enters the desorption bed.

In this example, a mild thermal swing is utilized to enhance the performance of the adsorption. The system parameters are as follows:

| | |
|---|---|
| System pressure | 350 psig |
| Hydrotreating temp | 575° F. |
| Adsorption temp | 350° F. |
| Desorption temp | 500° F. |
| $H_2$/Hydrocarbon (mole basis) | 1.0 |
| Total cycle time (ads + des) | 2 hours |

Measurement of the sulfur and nitrogen levels in the hydrotreater effluent demonstrates that all of the sulfur in the feed is converted to hydrogen sulfide and all of the nitrogen is converted to ammonia. During the adsorption portion of the cycle, no detectable amount of sulfur (hydrogen sulfide) or nitrogen (ammonia) is noted in the stream exiting the adsorber.

After the cycle is switched to desorption, the hydrogen sulfide and ammonia levels in the desorption effluent is monitored. An integration of the sulfur and nitrogen levels versus time is performed for both the adsorption feed and the desorption effluent. The comparison verifies that all sulfur and nitrogen entering with the adsorption feed leaves with the desorption effluent, confirming that no unsteady phenomena occurs.

EXAMPLE 2

A hydrocarbon feed containing 410 ppmw of sulfur (contained in a variety of sulfur bearing compounds) is to be subjected to a reforming operation. A feed quantity of 40 cc/min at a density of 0.65 g/cc (equivalent to 26 g/min) is introduced into a hydrotreating bed loaded with 300 grams of C20-8 Co/Mo hydrotreating catalyst, yielding a WHSV of 5.2 for the hydrotreating reaction.

The stream, now containing hydrogen sulfide, is then fed into an adsorber loaded with 400 grams of Zeolite 4A having a pore channel diameter of approximately 4 angstroms. A highly sensitive gas chromatagraph capable of resolving sulfur to below 0.1 ppmv is utilized to monitor the path of sulfur in the system. Sample taps are placed on the inlet and the exit of the adsorber beds.

The stream then enters a reformer after being heated to a temperature of 900° F. and leaves the reformer at that temperature.

In this example, the naturally occurring temperature is utilized to enhance the performance of the adsorption. The system parameters are as follows:

| | |
|---|---|
| System pressure | 350 psig |
| Hydrotreating temp | 575° F. |
| Adsorption temp | 575° F. |
| Desorption temp | 900° F. |
| $H_2$/Hydrocarbon (mole basis) | 1.0 |
| Total cycle time (ads + des) | 2 hours |

Measurement of the sulfur level in the hydrotreater effluent demonstrates that all of the sulfur in the feed is converted to hydrogen sulfide. During the adsorption portion of the cycle, no detectable amount of sulfur (hydrogen sulfide) is noted in the stream exiting the adsorber.

After the cycle is switched to desorption, the hydrogen sulfide level in the desorption effluent is monitored. An integration of the sulfur level versus time is performed for both the adsorption feed and the desorption effluent. The comparison verifies that all sulfur entering with the adsorption feed leaves with the desorption effluent, confirming that no unsteady state phenomena occurs.

EXAMPLE 3

One pound per hour of ammonia synthesis gas is to be reacted to form ammonia. The composition of the synthesis gas is the following:

| | |
|---|---|
| $N_2$ | 24.9 mole % |
| $H_2$ | 74.9 mole % |
| CO | 500 ppmv |
| $CO_2$ | 500 ppmv |

An adsorber is utilized which contains 1.0 lbs of 5A molecular sieve. The adsorber is maintained at 100° F. which is the exit temperature of the bulk $CO_2$ removal stage which precedes the ammonia synthesis. The capacity for the carbon oxides on the 5A molecular sieve under these conditions is 0.1 weight percent. The total flow of carbon oxides to the bed is 0.0043 lbs/hr. Thus, by cycling the bed 5 times per hour, sufficient capacity is achieved to handle this level of carbon oxides in the feed. After becoming saturated with carbon oxides, the bed is purged with the ammonia product at 300° F. before it is cooled and sent to storage.

EXAMPLE 4

Example 1 was repeated with the only exception being the introduction of 20 ppm of ethyl alcohol to the feed.

Dew point measurements on the adsorption effluent stream confirmed that the alcohol was properly converted to water in the hydrotreater, which water was then adsorbed by the Zeolite 4A bed.

The process is accordingly applicable to streams containing oxygenates such as alcohols.

EXAMPLE 5

A hydrocarbon feed comprised of 60% pentane and 40% hexane containing 5 ppmw of sulfur (contained as a variety of sulfur bearing compounds) is to be isomerized.

A feed quantity of 40 cc/min at a density of 0.65 g/cc (equivalent to 26 g/min) is heated to a temperature of 550° F. such that the feed is vaporized. The vaporous feed is then introduced to a hydrotreating bed loaded with 300 grams of C20-8 Co/Mo hydrotreating catalyst, yielding a weight hourly space velocity (WHSV) of 5.2 for the hydrotreating reaction.

The hydrotreating reaction is carried out at a temperature of 550° F. Hydrogen is introduced to the reactor at a 2:1 mole ratio to the hydrocarbon feed.

The stream, now containing hydrogen sulfide, is then fed to a bed containing 300 grams of zinc oxide.

A small air cooler is used to lower the temperature of the effluent leaving the zinc oxide bed to 500° F., still hot enough to keep the stream in the vapor state.

The stream then enters an isomerization reactor containing 945 grams of HS-10, an isomerization catalyst (Union Carbide Corporation, Danbury, Conn.), which results in a WHSV of 1.65 weight of feed/weight of catalyst per hour.

This entire system was operated at a pressure of 300 psia and entirely in the vapor phase.

Measurements of the hydrotreater effluent confirmed that all of the sulfur compounds had been converted to hydrogen sulfide and that 5 ppm hydrogen sulfide is contained in the feed to the isomerization reactor. Additional measurements of the sulfur levels exiting the zinc oxide bed confirmed that the isomerization reactor feed was sulfur-free.

What is claimed is:

1. In a process for the conversion of a hydrocarbon stream containing at least sulfur and/or nitrogen components in a reaction zone suitable for said conversion to produce a hydrocarbon product, said conversion being deleteriously affected by the presence of said sulfur and/or nitrogen components involving the steps of:

(i) catalytically reacting said hydrocarbon stream at a temperature and with sufficient molecular hydrogen to cataltically convert substantially all of the contained sulfur components to hydrogen sulfide and substantially all of the nitrogen components to ammonia, said temperature being such that the hydrocarbon stream is essentially in the vapor phase;

(ii) condensing the hydrocarbon stream to essentially the liquid phase;

(iii) introducing the liquid hydrocarbon stream to a hydrogen sulfide and ammonia removal means to provide a liquid hydrocarbon stream having a reduced content of hydrogen sulfide and/or ammonia;

(iv) vaporizing the liquid hydrocarbon stream having a reduced hydrogen sulfide and/or ammonia content to the vapor phase; and then (v) passing the hydrocarbon stream having reduced hydrogen sulfide and/or ammonia content while in the vapor phase to the reaction zone to produce the hydrocarbon product, the improvement which comprises:

(a) removing hydrogen sulfide and/or ammonia from the hydrocarbon stream by contacting the hydrogen sulfide and/or ammonia containing hydrocarbon stream, while in the vapor phase, with a zeolite adsorbent selective for the adsorption of hydrogen sulfide and ammonia as compared to the hydrocarbon having a pore diameter less than or equal to 5 Angstroms at adsorption conditions sufficient to maintain the hydrocarbon stream in the vapor phase and capable of achieving the reduction in hydrogen sulfide and/or ammonia to provide a hydrocarbon stream having reduced hydrogen sulfide and/or ammonia content, said adsorbent being on an adsorption mode for a period of no more than from about 0.5 to 6.0 hours; and then (b) passing the hydrocarbon stream having reduced hydrogen sulfide and/or ammonia content while still in the vapor phase, to the reaction zone at conditions suitable for the conversion to produce the hydrocarbon product including temperatures and pressures sufficient to maintain the hydrocarbon stream and hydrocarbon product essentially in the vapor phase.

2. The method of claim 1, wherein the adsorbent is regenerated when it becomes substantially laden with the hydrogen sulfide and/or ammonia.

3. The method of claim 1, wherein the adsorbent is regenerated before there is any breakthrough of hydrogen sulfide and/or ammonia from the adsorbent.

4. The method of claim 1, wherein the adsorbent is zeolite 4A, zeolite 5A or clinoptilolite.

5. The method of claim 1, wherein the adsorption temperature is in the range of from about 300° to 550° F.

6. The method of claim 1, wherein the period for the adsorption step is in the range of from about 0.2 to 2.0 hours.

7. The method of claim 6, wherein the period for the adsorption step is in the range of from about 0.75 to 1.5 hours.

8. A process for the conversion of hydrocarbon stream containing sulfur and/or nitrogen components in a reaction zone suitable for said conversion to produce a hydrocarbon product, said conversion being deleteriously affected by the presence of said sulfur and/or nitrogen components comprising:

(a) catalytically reacting said hydrocarbon stream at a temperature and with sufficient molecular hydrogen to catalytically convert substantially all of the contained sulfur components to hydrogen sulfide an substantially all of the nitrogen componenets to ammonia, said temperature being such that the hydrocarbon stream is essentially in the vapor phase;

(b) contacting the vaporous hydrogen sulfide and/or ammonia containing hydrocarbon stream with a ziolitic adsorbent selective for the adsorption of hydrogen sulfide and ammonia as compared to the hydrocarbon having a pore diameter less than or equal to 5 Angstrom at adsorption conditions sufficient to maintain the hydrocarbon stream in the vapor phase and capable of achieving the reduction of hydrogen sulfide and ammonia content in the hydrocarbon stream to provide a hydrocarbon stream having reduced hydrogen sulfide and ammonia content, said adsorbent being on an adsorption mode for a period of no more than from about 0.5 to 6.0 hours; and then (c) passing the hydrocarbon stream having reduced hydrogen sulfide and/or ammonia content, while still in the vapor phase, to the reaction zone at conditions suitable for the conversion to produce the hydrocarbon product including temperatures and pressures sufficient to maintain the hydrocarbon and hydrocarbon product essentally in the vapor phase.

9. An integrated process for the hydrodesulfurization and isomerization of hydrocarbon feed containing at least four carbon atoms which feed contains at least sulfur and/or nitrogen components comprising:

(a) providing said hydrocarbon feed at a temperature and with sufficient molecular hydrogen to catalytically convert substantially all of the contained sulfur components to hydrogen sulfide and substantially all of the contained nitrogen components to ammonia, said temperature being such that the hydrocarbon feed is essentially in the vapor phase;

(b) passing the vaporous hydrocarbon feed mixture to a catalytic reaction zone, containing a catalytically effective amount of catalyst under hydrogen sulfide and ammonia forming conditions to provide substantially all of the contained sulfur components and nitrogen components in the hydrocarbon feed mixture in the form of hydrogen sulfide and ammonia, respectively, and thereby produce a hydrogen sulfide and/or ammonia vaporous containing hydrocarbon stream;

(c) maintaining the hydrogen sulfide and/or ammonia containing hydrocarbon stream at a temperature at least sufficient to maintain the hydrogen sulfide and/or ammonia containing hydrocarbon stream essentially in the vapor phase and contacting the hydrogen sulfide and/or ammonia containing stream with a zeolitic adsorbent selective for the adsorption of hydrogen sulfide and ammonia as compared to the hydrocarbon at adsorption conditions sufficient to maintain the hydrocarbon stream in the vapor phase and capable of achieving the reduction in hydrogen sulfide and ammonia content in the hydrocarbon stream to provide a hydrocarbon stream having reduced hydrogen sulfide and/or ammonia content; and (d) maintaining and hydrocarbon stream having reduced hydrogen sulfide and/or ammonia content in the vapor phase and passing the vaporous stream to an isomerization reaction zone containing a catalytically effective amount of isomerization catalyst which is deleteriously affected by the presence of hydrogen sulfide and/or ammonia under isomerization conditions sufficient to maintain the stream in the vapor phase and to provide a vaporous isomerate containing product effluent.

10. An integrated process for the hydrodesulfurization and catalytic reforming of hydrocarbon feed containing at least four carbon atoms which feed contains at least sulfur and/or nitrogen components comprising:

(a) providing said hydrocarbon feed at a temperature and with sufficient molecular hydrogen to catalytically convert substantially all of the contained sulfur components to hydrogen sulfide and substantially all of the contained nitrogen components to ammonia, said temperature being such that the hydrocarbon feed is essentially in the vapor phase;

(b) passing the vaporous hydrocarbon feed mixture to a catalytic reaction zone containing a catalytically effective amount of catalyst under hydrogen sulfide and ammonia forming conditions to provide substantially all of the contained sulfur components and nitrogen components in the hydrocarbon feed mixture in the form of hydrogen sulfide and ammonia, respectively, and thereby produce a hydrogen sulfide and/or ammonia vaporous containing hydrocarbon stream;

(c) maintaining the hydrogen sulfide and/or ammonia containng hydrocarbon stream at a temperature at least sufficient to maintain the hydrogen sulfide and/or ammonia containing hydrocarbon stream essentially in the vapor phase and contacting the hydrogen sulfide and/or ammonia containing hydrocarbon stream with a zeolitic adsorbent selective for the adsorption of hydrogen sulfide and ammonia as compared to the hydrocarbon at adsorption conditions sufficient to maintain the hydrocarbon stream in the vapor phase and capable of achieving the reduction in hydrogen sulfide and ammonia content in the hydrocarbon stream to provide a hydrocarbon stream having reduced hydrogen sulfide and/or ammonia content; and (d) maintaining the hydrocarbon stream having reduced hydrogen sulfide and/or ammonia content in the vapor phase and passing the vaporous stream to a catalytic reforming reaction zone containing a catalytically effective amount of reforming catalyst which is deleteriously affected by the presence of hydrogen sulfide and/or ammonia under reforming conditions sufficient to maintain the stream in the vapor phase and to provide a vaporous reformate containing product effluent.

11. The method of claims 1, 8, 9, or 10, wherein the adsorption conditions are essentially the same as the conditions within the reaction zone.

12. The method of claims 1, 8, 9, or 10, wherein the hydrocarbon stream is light straight run gasoline, light hydrocrackate, or light reformate.

13. The method of claims 1 or 8, wherein the reaction zone is an isomerization reactor or a catalytic reformer.

14. The method of claim 9, wherein the adsorption conditions and the isomerization conditions are both in the range of from about 300° to 550° F. and about 150 to 400 psig.

15. The method of claims 8, 9, or 10, wherein the adsorbent is zeolite 4A, zeolite 5A, or clinoptilolite.

16. The method of claims 1, 8, 9, or 10, wherein the amount of sulfur components present in the hydrocarbon stream is in the range of from about 0 to 400 ppmw.

17. The method of claims 1, 8, 9, or 10, wherein the amount of nitrogen components present in the hydrocarbon streama is in the range of from about 0 to 50 ppmw.

18. The method of claim 10, wherein the adsorption conditions and the catalytic reforming conditions are both in the range of from about 500° to 900° F. and about 100 to 400 psig.

19. The method of claims 8, 9, or 10, wherein the adsorbent is regenerated before there is any breakthrough of the at least one other component from the adsorbent.

20. The method of claims 8, 9, or 10, wherein the period for the adsorption step is in the range of from about 0.2 to 2.0 hours.

21. The method of claims 8, or 10, wherein the adsorption temperature is in the range of from about 300° to 550° F.

* * * * *